US010120326B2

(12) United States Patent
Yamasaki

(10) Patent No.: US 10,120,326 B2
(45) Date of Patent: Nov. 6, 2018

(54) MANUFACTURING METHOD FOR CARTRIDGE ATTACHABLE TO IMAGE FORMING APPARATUS AND CARTRIDGE

(71) Applicant: CANON KABUSHIKI KAISHA, Tokyo (JP)

(72) Inventor: Toshiteru Yamasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/415,963

(22) Filed: Jan. 26, 2017

(65) Prior Publication Data

US 2017/0219991 A1 Aug. 3, 2017

(30) Foreign Application Priority Data

Jan. 29, 2016 (JP) ..... 2016-016728

(51) Int. Cl.

| | |
|---|---|
| ***G03G 15/00*** | (2006.01) |
| ***G03G 21/16*** | (2006.01) |
| ***G03G 15/08*** | (2006.01) |
| ***G03G 21/18*** | (2006.01) |

(52) U.S. Cl.

CPC ..... *G03G 21/1619* (2013.01); *G03G 15/0882* (2013.01); *G03G 15/0894* (2013.01); *G03G 21/1676* (2013.01); *G03G 21/181* (2013.01); *G03G 2215/0135* (2013.01)

(58) Field of Classification Search

CPC ..... G03G 21/181; G03G 2215/00987

See application file for complete search history.

(56) References Cited

U.S. PATENT DOCUMENTS

| | | | | |
|---|---|---|---|---|
| 5,294,960 | A * | 3/1994 | Nomura | G03G 15/0898 399/113 |
| 5,585,902 | A | 12/1996 | Nishiuwatoko et al. | |
| 7,062,199 | B1 * | 6/2006 | Higeta | G03G 21/181 399/109 |
| 8,918,011 | B2 | 12/2014 | Yamasaki et al. | |
| 9,128,417 | B2 | 9/2015 | Yamasaki et al. | |
| 9,367,023 | B2 | 6/2016 | Yamasaki et al. | |
| 9,377,716 | B2 | 6/2016 | Yamasaki et al. | |
| 2003/0123900 | A1 | 7/2003 | Higeta et al. | |

(Continued)

FOREIGN PATENT DOCUMENTS

| | | | |
|---|---|---|---|
| JP | H07-302034 | A | 11/1995 |
| JP | 2001-125469 | A | 5/2001 |

(Continued)

*Primary Examiner* — Ryan Walsh

(74) *Attorney, Agent, or Firm* — Fitzpatrick, Cella, Harper & Scinto

(57) ABSTRACT

There is provided a manufacturing method of manufacturing a cartridge by using a cartridge having a rotator, a frame that supports the rotator, an elastic member that is provided in a concave portion formed in the frame along a rotation axis direction of the rotator, and a sheet member that has one end fixed to the elastic member and the other end abutting on the rotator along the rotation axis direction of the rotator, and the manufacturing method includes: detaching the rotator from the frame; detaching the sheet member from the frame; detaching the elastic member from the frame; and attaching another sheet member to the frame via an adhesive member that is attached to an adhesive member attachment portion formed in the concave portion of the frame.

18 Claims, 28 Drawing Sheets

(56) References Cited

U.S. PATENT DOCUMENTS

| | | | | |
|---|---|---|---|---|
| 2003/0202817 | A1 | 10/2003 | Higeta et al. | |
| 2005/0276628 | A1* | 12/2005 | Anan | G03G 21/181 399/109 |
| 2012/0269540 | A1 | 10/2012 | Kawai et al. | |
| 2013/0121720 | A1 | 5/2013 | Hoshi et al. | |
| 2015/0220020 | A1 | 8/2015 | Hayashi et al. | |

FOREIGN PATENT DOCUMENTS

| | | | | |
|---|---|---|---|---|
| JP | 2003-140531 | A | | 5/2003 |
| JP | 2003-316235 | A | | 11/2003 |
| JP | 2012-226277 | A | | 11/2012 |
| JP | 2013-101267 | A | | 5/2013 |
| JP | 2013101267 | A | * | 5/2013 |

* cited by examiner

B-B CROSS SECTION

E-E CROSS SECTION

E-E CROSS SECTION

MANUFACTURING METHOD FOR CARTRIDGE ATTACHABLE TO IMAGE FORMING APPARATUS AND CARTRIDGE

BACKGROUND OF THE INVENTION

Field of the Invention

The present invention relates to a reproduction method for a cartridge of an image forming apparatus (a manufacturing method for a new cartridge), and a cartridge.

The cartridge mentioned herein is obtained by integrating at least one of development means and cleaning means and an electrophotographic image carrier into a cartridge, and the cartridge is made attachable and detachable to and from an image forming apparatus.

The image forming apparatus mentioned herein forms an image on a recording medium by using an electrophotographic image forming method, and examples thereof include an electrophotographic copier, an electrophotographic printer (e.g., a laser beam printer, an LED printer, and the like), and a facsimile.

Description of the Related Art

Conventionally, the image forming apparatus of this type adopts a method in which a cartridge is obtained by integrating a photoreceptor (image carrier) and process means that acts on the photoreceptor into a unit, and the cartridge is made attachable and detachable to and from the image forming apparatus.

Such a cartridge forms a toner image on the photoreceptor by using a developer (hereinafter referred to as toner) and transfers the toner image onto the recording medium, and the toner is consumed as the image formation is performed. When the toner is consumed to such an extent that an image having quality that satisfies a user cannot be formed, the cartridge loses its commercial value. As a simple reproduction method for the cartridge that allows commercialization of the cartridge of which the commercial value is lost as the result of the consumption of the toner (a manufacturing method for a new cartridge), Japanese Patent No. 3126968 proposes a method.

That is, as shown in FIG. 22, when reproduction is performed, there are cases where an undulation y occurs in a sheet 201 functioning as a sealing member of the toner that is attached to a cleaning container 200 or the sheet 201 peels off at the time of disassembly, and the sheet 201 does not exert its function.

To cope with this, at the time of reproduction of the process cartridge, a developing roller is detached from a developing container, a seal member stuck to the developing container is peeled, and a new seal member is stuck. In addition, with regard to the sheet stuck to the cleaning container, the old sheet is also peeled and a new sheet is stuck, and the reproduction is thereby performed.

SUMMARY OF THE INVENTION

The present invention has been achieved by further evolving the above related art, and an object thereof is to provide a manufacturing method of manufacturing a cartridge by fixing a seal member and a thin plate member such as a sheet, and a cartridge.

An object of the present invention is to provide a manufacturing method of manufacturing a cartridge attachable to an image forming apparatus by using a cartridge having a rotator, a frame that supports the rotator, an elastic member that is provided in a concave portion formed in the frame along a rotation axis direction of the rotator, and a sheet member that has one end fixed to the elastic member and another end abutting on the rotator along the rotation axis direction of the rotator, the manufacturing method comprising:

detaching the rotator from the frame;

detaching the sheet member from the frame;

detaching the elastic member from the frame; and attaching another sheet member to the frame via an adhesive member that is attached to an adhesive member attachment portion formed in the concave portion of the frame.

Further features of the present invention will become apparent from the following description of exemplary embodiments (with reference to the attached drawings).

DESCRIPTION OF THE EMBODIMENTS

Hereinbelow, with reference to the drawings, the best mode for carrying out the invention will be illustratively described in detail based on embodiments.

Embodiment 1

Hereinbelow, embodiments according to the present invention will be described in detail based on the drawings, and the embodiments are not intended to limit the present invention. Note that, in the following description, a longitudinal direction of a cartridge denotes a rotation axis direction of an image carrier. In addition, the left and the right of the cartridge denote one end side and the other end side in the longitudinal direction. Further, an upper surface of the cartridge denotes a surface positioned on an upper side in a state in which the cartridge is attached to an electrophotographic image forming apparatus, and a lower surface thereof denotes a surface positioned on a lower side.

(Configuration of Image Forming Apparatus)

Figure 1:
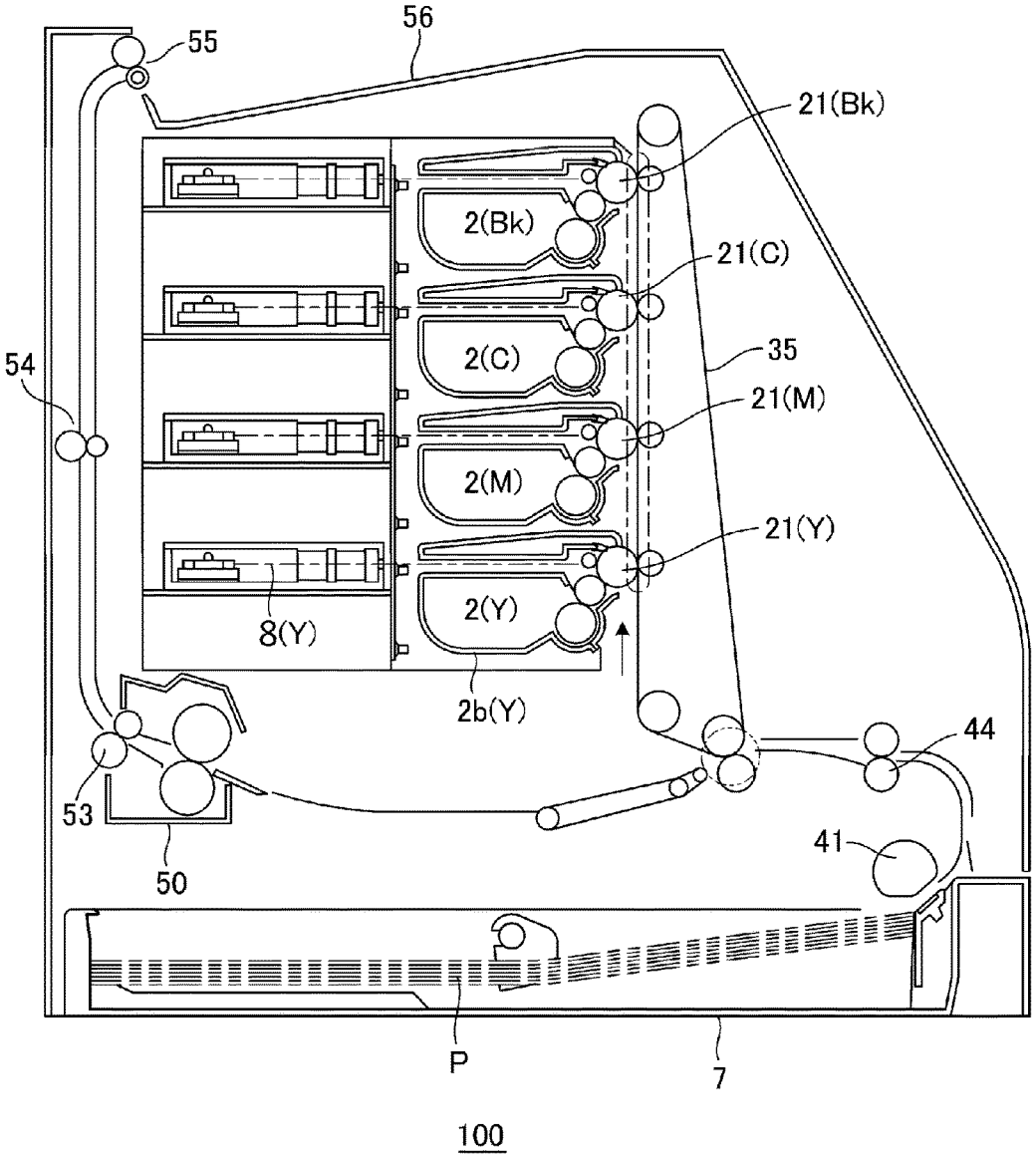
FIG. 1 is a schematic cross-sectional view showing the entire configuration of an image forming apparatus.

First, the configuration of an electrophotographic image forming apparatus will be described by using FIG. 1. FIG. 1 is a schematic cross-sectional view of a color laser beam printer (hereafter referred to as an "image forming apparatus") as an embodiment of the image forming apparatus.

As shown in FIG. 1, an image forming apparatus 100 includes cartridges 2 of individual colors of Y, M, C, and Bk, and an intermediate transfer body 35 that transfers color images developed on image carriers 21 as rotators onto a transfer material P. Further, the image forming apparatus 100 includes a fixation portion 50 that fixes the color images onto the transfer material P and three discharge roller pairs 53, 54, and 55 that discharge the transfer material P onto a discharge tray 56, and the above cartridges 2 of four colors are configured to be individually attachable and detachably to and from the image forming apparatus 100. Next, the operation of the image forming apparatus 100 will be described.

First, a paper feed roller 41 rotates to separate one sheet from the transfer material P in a paper feed cassette 7, and transfers the sheet to a register roller 44. On the other hand, each of the image carriers 21 and the intermediate transfer body 35 rotate in a direction of an arrow in FIG. 1 at a predetermined peripheral speed V (hereinafter referred to as a process speed). The surface of the image carrier 21 is uniformly electrified by electrification means and the image carrier 21 is then subjected to laser exposure from an exposure apparatus 8, whereby the image carrier 21 forms an electrostatic latent image. Concurrently with the latent image formation, a developing unit 2*b* performs development of the latent image on the image carrier 21 with toner. The color images of Y, M, C, and Bk colors developed on the image carriers 21 are transferred to the outer periphery of the intermediate transfer body 35 by primary transfer. The images of the individual colors transferred onto the intermediate transfer body 35 are transferred to the transfer material P by secondary transfer, and are then fixed onto the transfer material P by the fixation portion 50. The transfer material P on which the images are fixed is discharged onto the discharge tray 56 via the discharge roller pairs 53, 54, and 55, and the image formation operation is ended.

(Cartridge Configuration)

Next, the configuration of the cartridge 2 of the present invention will be described by using FIG. 2.

Figure 2:
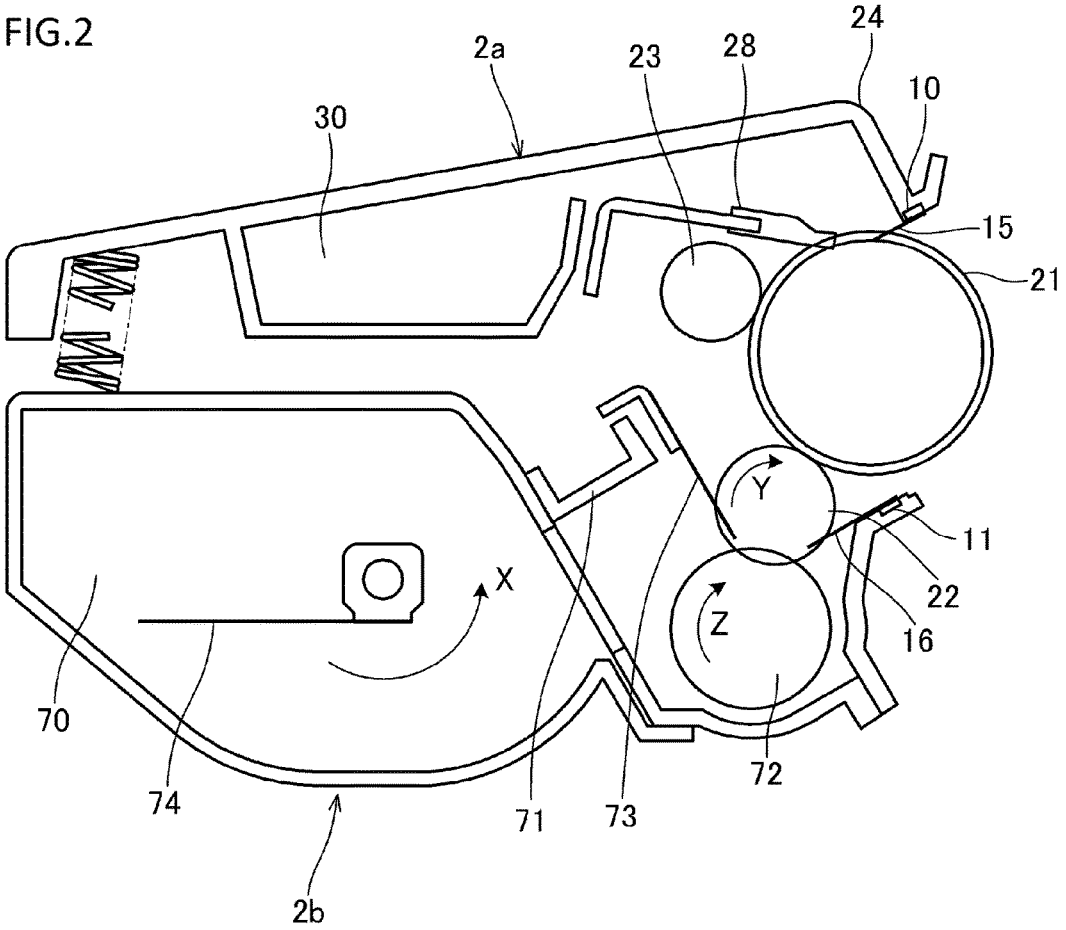
FIG. 2 is a schematic cross-sectional view of a cartridge of FIG. 1.

FIG. 2 is a schematic cross-sectional view of the cartridge 2. Note that the cartridges 2 of Y, M, C, and Bk have the same configuration. The cartridge 2 is divided into a cleaning unit 2*a* and a developing unit 2*b*.

In the cleaning unit 2*a*, the image carrier 21 as the rotator is rotatably attached to a cleaning container 24 serving as a frame. On the periphery of the image carrier 21, an electrification roller 23 as primary electrification means for uniformly electrifying the surface of the image carrier 21 and a cleaning blade 28 for removing a residue such as waste toner that remains on the image carrier 21 are disposed. In addition, a sheet 15 as a thin plate member for scooping the residue such as the waste toner removed by the cleaning blade 28 and an elastomer member (elastic member) 10 that fixes the sheet 15 are disposed in the cleaning container 24. The residue such as the waste toner is stored in a waste toner chamber 30 formed in the cleaning container 24.

In the developing unit 2*b*, a developer carrier 22 as development means is rotatably supported by a developing container 71. On the periphery of the developer carrier 22, a developing blade unit 73 as a developer regulating member, and a toner supply roller 72 that comes into contact with the developer carrier 22 and rotates in a direction of an arrow Z are disposed. Further, a sheet 16 that is a flexible member for preventing blowoff (leakage) of the toner from the developing container 71 and serves as a thin plate member, and an elastomer member (elastic member) 11 that fixes the sheet 16 are disposed in the developing container 71. Note that a toner stirring mechanism 74 is provided in a toner container 70.

Next, the operation of the cartridge 2 will be described.

First, the toner is transported to the toner supply roller 72 by the toner stirring mechanism 74. The toner supply roller 72 supplies the toner to the developer carrier 22 by rotating in the direction of the arrow Z in FIG. 2. The toner supplied onto the developer carrier 22 reaches the developing blade unit 73 with the rotation of the developer carrier 22 in a Y direction. The developing blade unit 73 regulates the toner to provide a desired electrification charge amount, and forms a predetermined toner thin layer. The toner regulated by the developing blade unit 73 is transported to a developing portion at which the image carrier 21 comes into contact with the developer carrier 22, and is developed on the image carrier 21 by a developing bias applied to the developer carrier 22. The toner developed on the image carrier 21 is transferred to the intermediate transfer body 35 by primary transfer, and the waste toner remaining on the image carrier is removed by the cleaning blade 28. The removed waste toner is stored in the waste toner chamber 30.

(Cleaning Unit)

Figure 3:
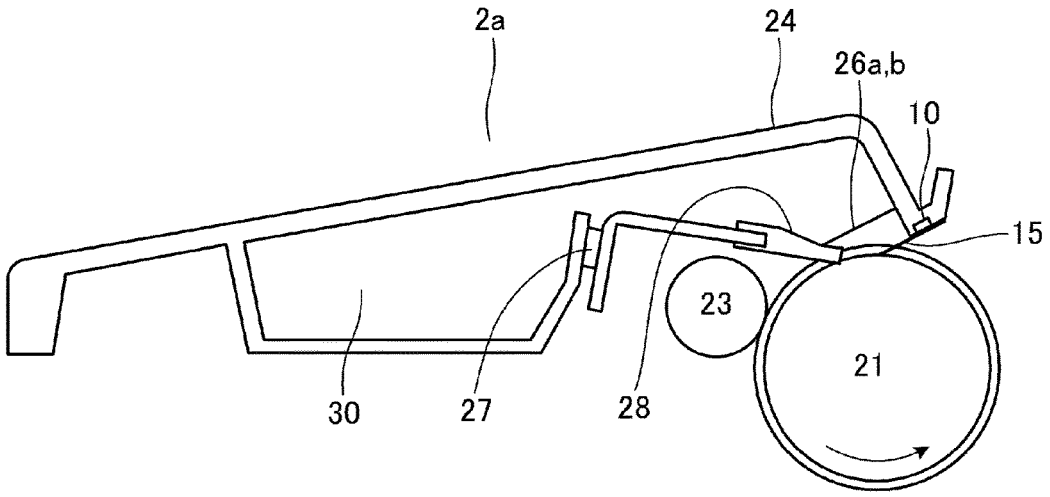
FIG. 3 is a schematic cross-sectional view showing the configuration of a cleaning unit of FIG. 2.

Next, the configuration of the cleaning unit 2*a* will be described by using FIGS. 3 to 5. FIG. 3 is a schematic cross-sectional view showing the configuration of the cleaning unit 2*a*, FIG. 4 is a schematic cross-sectional view showing the configuration of the cleaning unit 2*a* from which the image carrier 21 is detached, and FIG. 5 is an explanatory view of a configuration when the configuration of part of the cleaning unit 2*a* is viewed from a direction of an arrow Q in FIG. 4.

Figure 4:
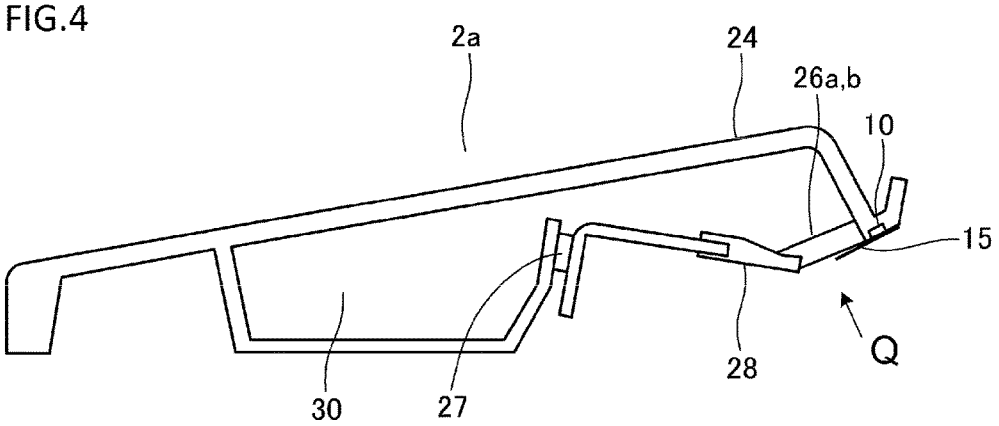
FIG. 4 is a schematic cross-sectional view of the cleaning unit from which an image carrier of FIG. 2 is detached.
Figure 5:
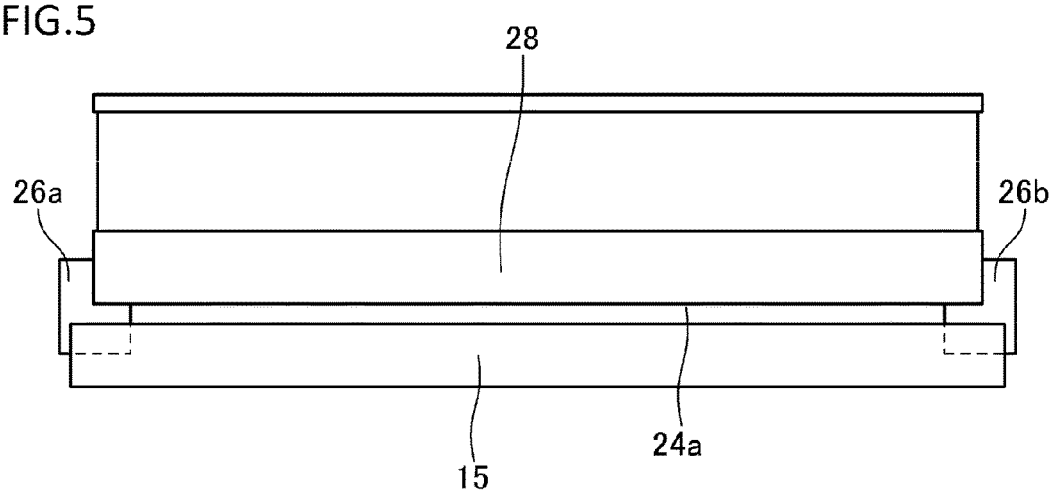
FIG. 5 is an explanatory view of a configuration when viewed from a direction of an arrow Q in FIG. 4.

As shown in FIGS. 3 and 4, the sheet 15 is a flexible member that prevents toner leakage (developer leakage) to the outside. The sheet 15 has end portion seal members 26*a* and 26*b* disposed at both end portions of the cleaning blade 28 and a lower seal 27 disposed between the cleaning blade 28 and the cleaning container 24 in order to prevent the leakage of the residue from the waste toner chamber 30. The individual members are incorporated into the cleaning container 24, and the cleaning unit 2*a* is thereby configured.

Specifically, the cleaning blade 28 and the sheet 15 abut on the outer peripheral surface of the image carrier 21 at positions that do not interfere with each other. Further, the sheet 15 is fixed to the cleaning container 24 via an elastomer member 10. The elastomer member 10 is molded so as to enter into part of the fiber-like end portion seal members 26*a* and 26*b* and, thereafter, the sheet 15 is thermally welded to part of the elastomer member 10 (the detail thereof will be described later). In addition, as shown in FIG. 5, the end portion seal members 26*a* and 26*b* are disposed with respect to the cleaning blade 28 and are in contact with both end portions of the sheet 15 and, as shown in FIG. 3, the end portion seal members 26*a* and 26*b* are also in contact with the outer peripheral surface of the image carrier 21. Further, for instance, a gap between the cleaning blade 28 and the cleaning container 24 is sealed by the lower seal 27.

The internal space of the cleaning container 24 is the waste toner chamber 30 (developer storage portion) that accommodates the scraped toner, an opening portion 24*a* of the cleaning container 24 corresponds to an opening portion of the waste toner chamber 30, and the image carrier 21 as the rotator is rotatably provided in the opening portion 24*a*.

(Developing Unit)

Next, the configuration of the developing unit 2*b* of the present invention will be described by using FIGS. 6 to 8.

Figure 6:
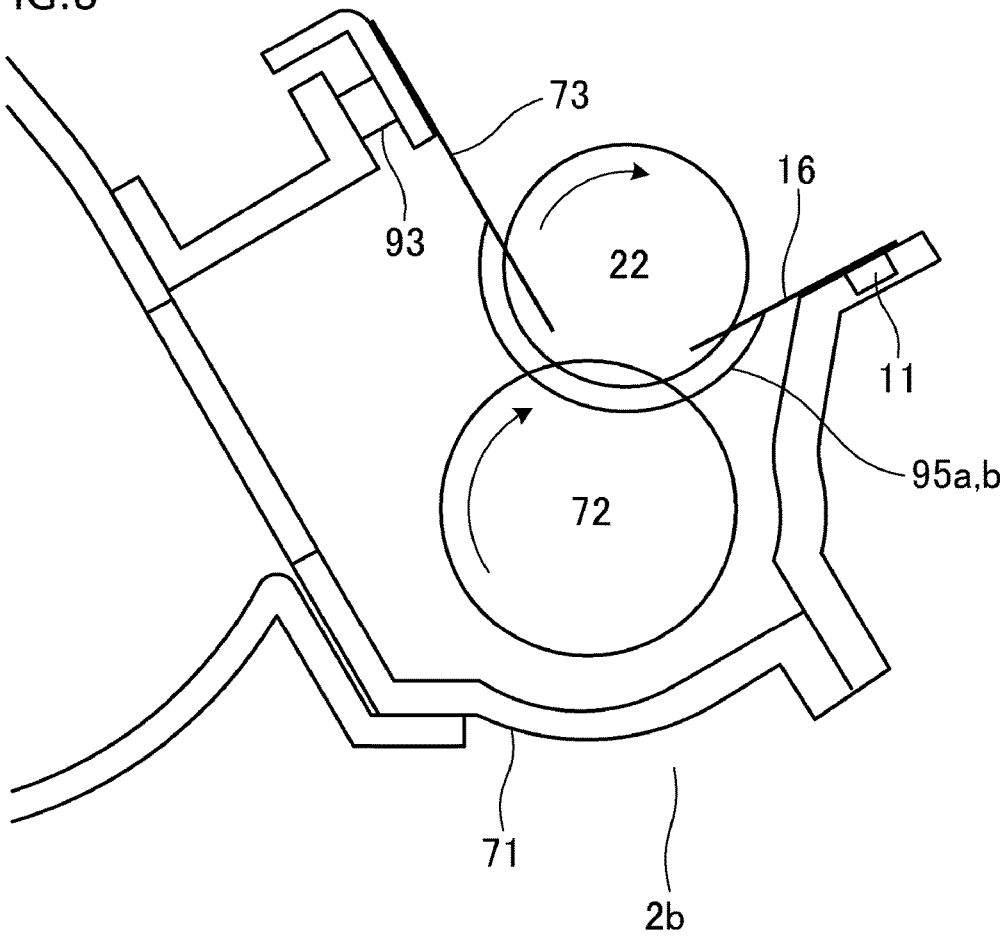
FIG. 6 is a schematic cross-sectional view showing the configuration of a developing unit.
Figure 7:
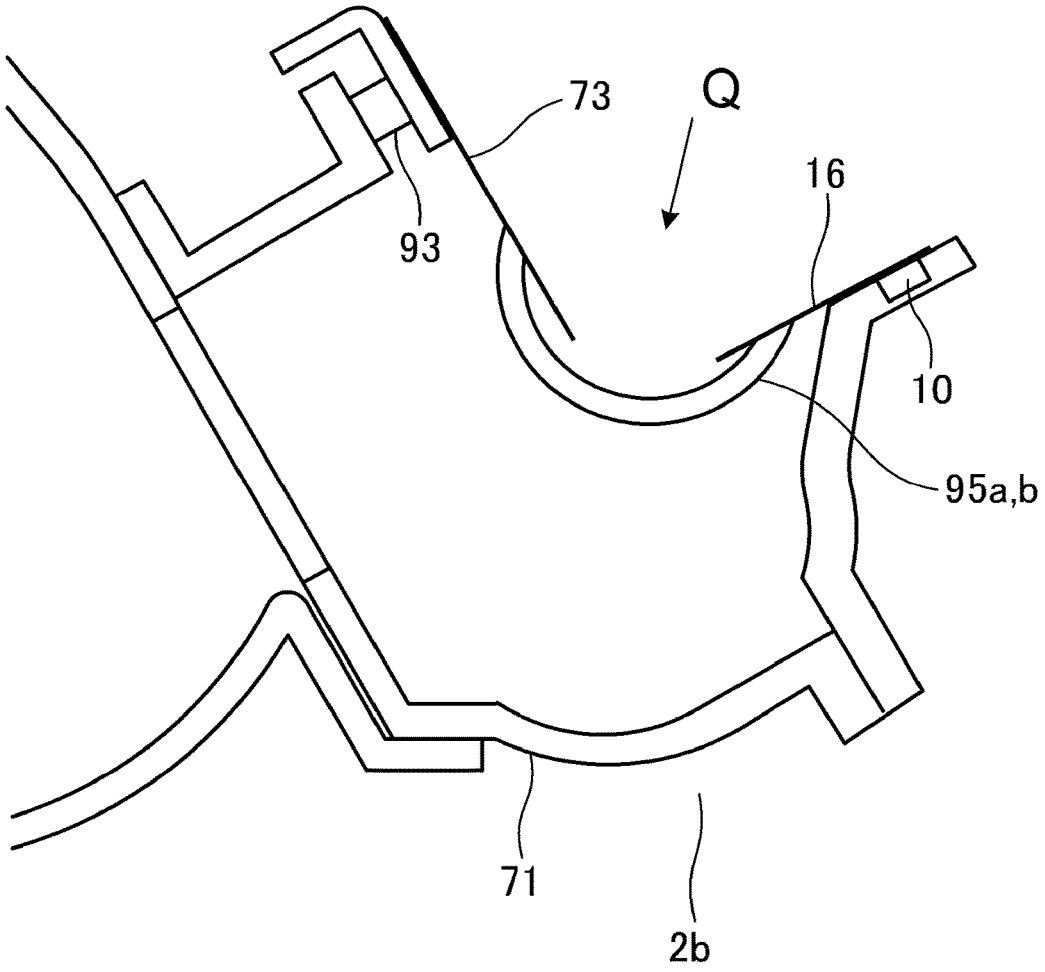
FIG. 7 is a schematic cross-sectional view of the developing unit from which a developer carrier and a toner supply roller are detached.
Figure 8:
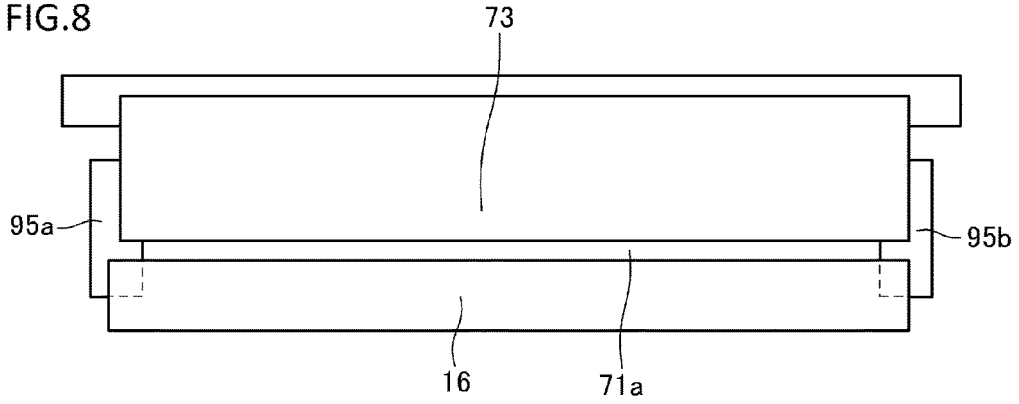
FIG. 8 is an explanatory view of a configuration when viewed in a direction of an arrow Q in FIG. 7.

FIG. 6 is a schematic cross-sectional view showing the configuration of the developing unit 2*b*, FIG. 7 is a schematic cross-sectional view showing the configuration of the developing unit 2*b* from which the developer carrier 22 and the toner supply roller 72 are detached, and FIG. 8 is an explanatory view of a configuration when the configuration of part of the developing unit 2*b* is viewed from a direction of an arrow Q in FIG. 7.

As shown in FIGS. 6 and 7, the internal space of the developing container 71 is a toner storage portion (developer storage portion), and the developer carrier 22 as the rotator is rotatably provided in an opening portion 71*a*. In addition, the developing unit 2*b* has end portion seal members 95*a* and 95*b* disposed at both end portions of the developing blade unit 73, and a developing blade lower seal 93 disposed between the developing blade unit 73 and the developing container 71, in order to prevent the leakage of the toner from the developing container 71. The individual members are incorporated into the developing container 71, and the developing unit 2*b* is thereby configured.

Specifically, the developing blade unit 73 and the sheet 16 abut on the outer peripheral surface of the developer carrier 22 at positions that do not interfere with each other. Further, the sheet 16 is fixed to the developing container 71 via the elastomer member 11. The elastomer member 11 is molded so as to enter into part of the fiber-like end portion seal members 95*a* and 95*b* and, thereafter, the sheet 16 is thermally welded to part of the elastomer member 11 (the detail thereof will be described later). In addition, as shown in FIG. 8, the end portion seal members 95*a* and 95*b* are in contact with both end portions of the developing blade unit 73 and the sheet 16 and, as shown in FIG. 6, the end portion seal members 95*a* and 95*b* are also in contact with the outer peripheral surface of the developer carrier 22. Further, for instance, a gap between the developing blade unit 73 and the developing container 71 is sealed by the developing blade lower seal 93. That is, the sheet 16 is a flexible member that prevents the toner leakage (developer leakage) to the outside.

(Molding of Elastomer Member)

Next, steps of molding the elastomer member 10 will be described by using FIGS. 9A to 11B.

Figure 9A:
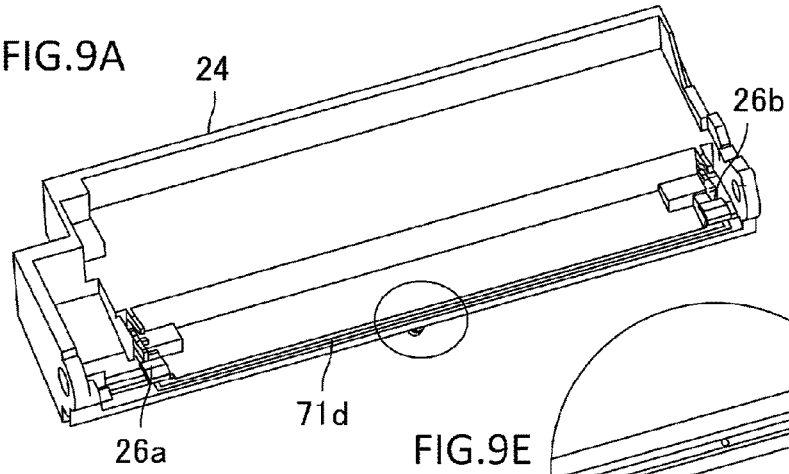
FIG. 9A is a schematic view of a cleaning container.
Figure 9E:
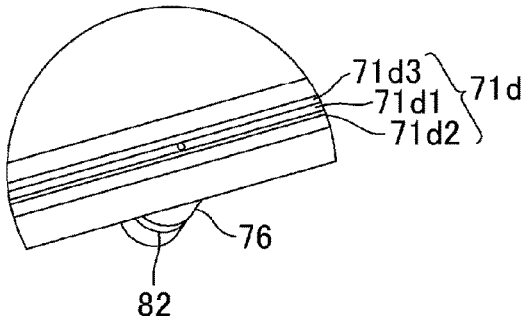
FIG. 9E is a partially enlarged view of FIG. 9A.
Figure 9B:
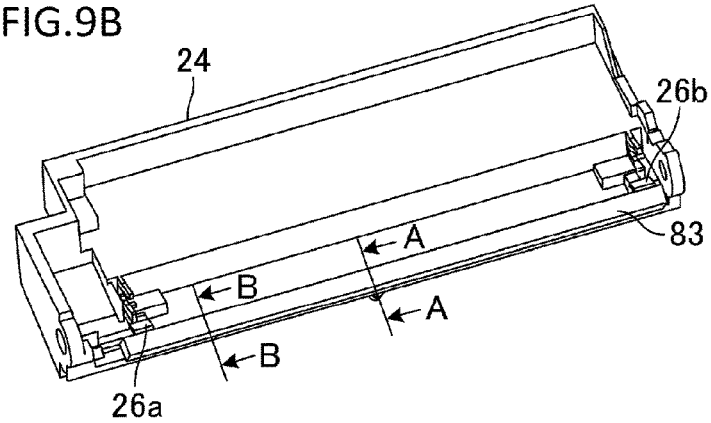
FIG. 9B is a schematic view showing a state in which an elastomer mold is clamped to the cleaning container of FIG. 9A.
Figure 9C:
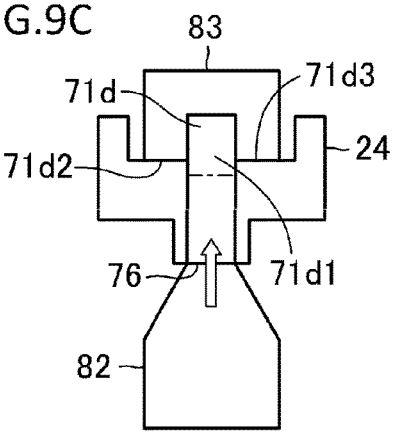
FIG. 9C is an enlarged cross-sectional view taken along the line A-A of FIG. 9B.
Figure 9D:
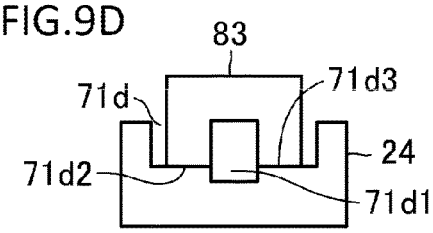
FIG. 9D is an enlarged cross-sectional view taken along the line B-B of FIG. 9B.

FIG. 9A is a schematic view of the cleaning container 24, and FIG. 9E is an enlarged schematic view of a vicinity of an inlet portion thereof. FIG. 9B is a schematic view showing a state in which an elastomer mold 83 is clamped to the cleaning container 24 in FIG. 9A. FIG. 9C is an enlarged schematic cross-sectional view taken along the line A-A of FIG. 9B, and FIG. 9D is an enlarged schematic cross-sectional view taken along the line B-B thereof.

Figure 10:
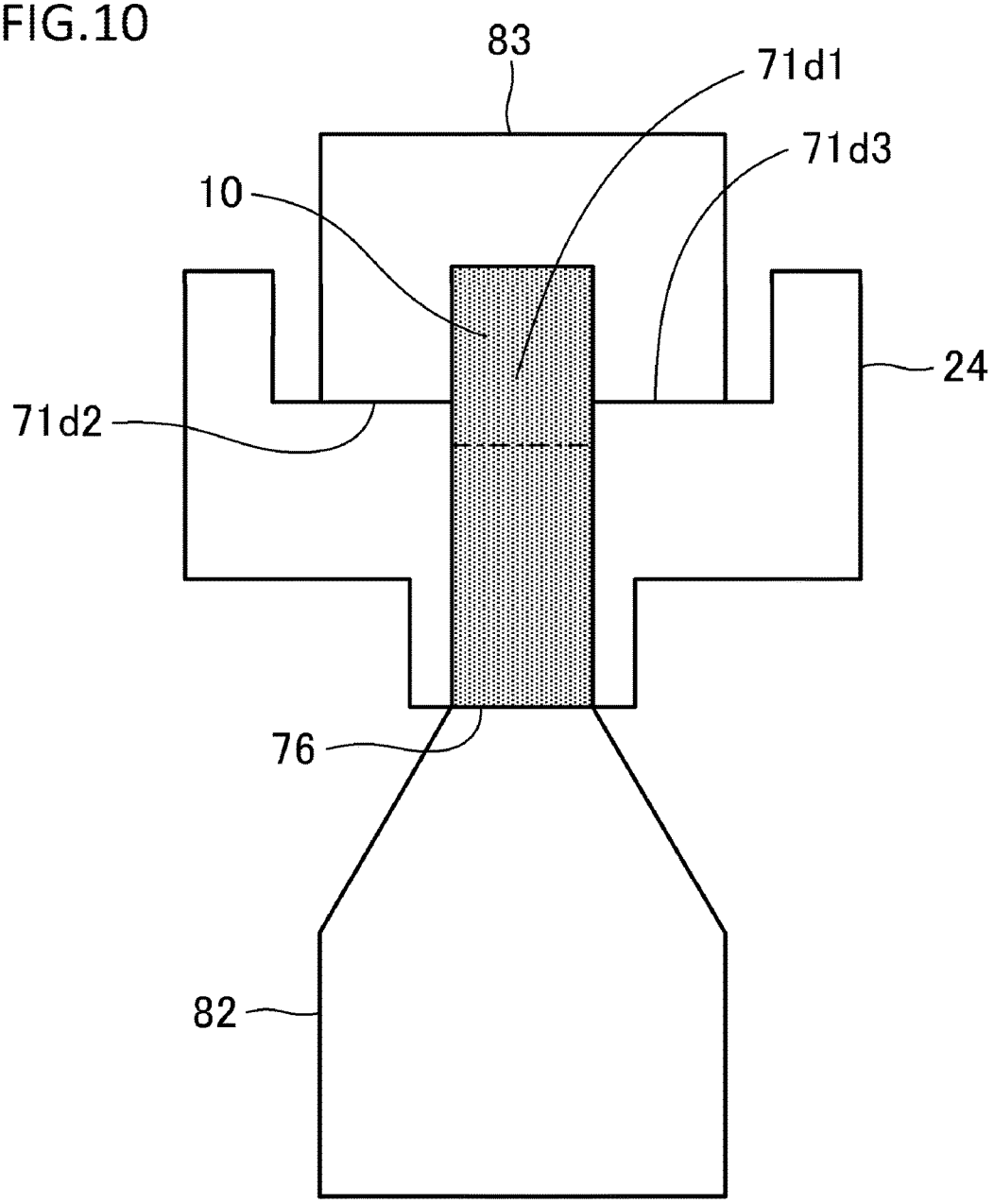
FIG. 10 is an enlarged schematic view along the A-A line of FIG. 9B when an elastomer member is molded.
Figures 11A, 11B:
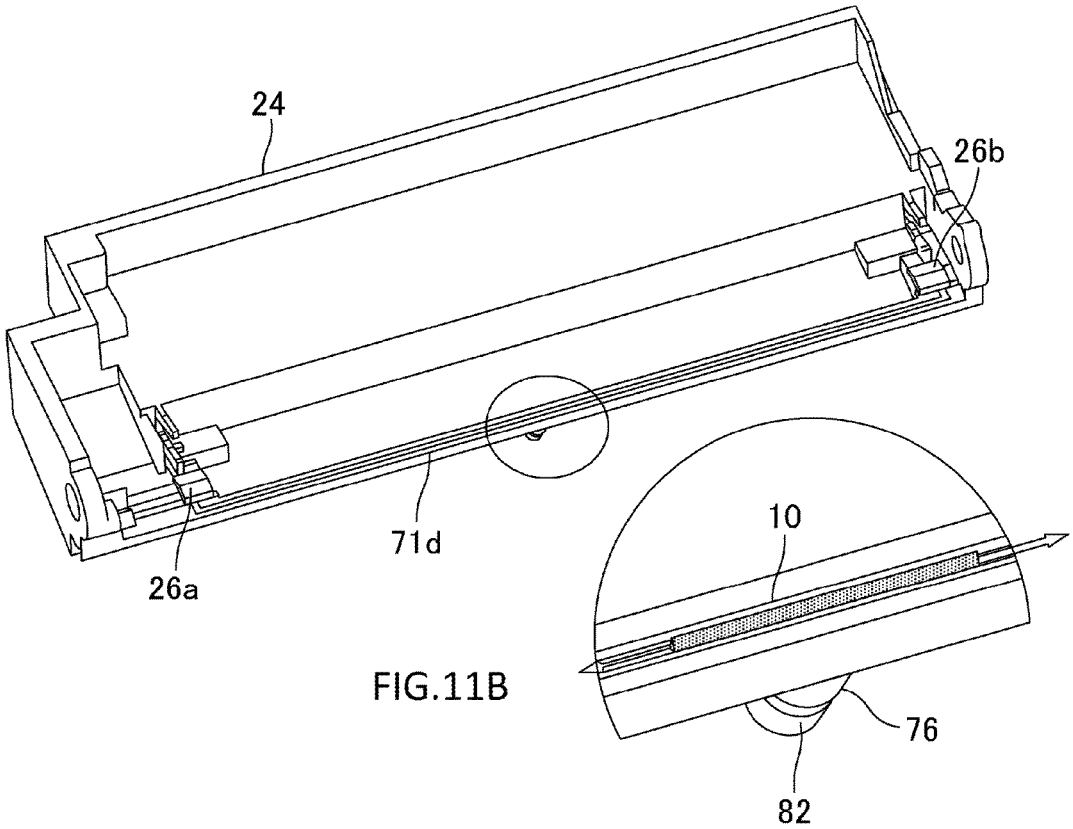
FIG. 11A is a schematic view of the cleaning container.
FIG. 11B is an enlarged schematic view of an inlet portion of FIG. 11A.

FIG. 10 is a schematic cross-sectional view taken along the line A-A of FIG. 9B at the time of molding of the elastomer member 10, and FIGS. 11A and 11B are schematic views of the cleaning container 24.

As shown in FIGS. 9A and 9B and FIGS. 11A and 11B, an elastomer member forming portion 71*d* is provided between the end portion seal member 26*a* on one end side of the cleaning container 24 and the end portion seal member 26*b* on the other end side thereof. In addition, as shown in FIGS. 9C to 9E and FIG. 10, the elastomer member forming portion 71*d* has a concave portion 71*d*1 into which the elastomer member 10 is injected and abutment surfaces 71*d*2 and 71*d*3 on which a mold abuts. In addition, as shown in FIG. 9A to 9C, FIG. 10, and FIGS. 11A and 11B, at a predetermined position in the longitudinal direction, an inlet 76 that passes through the cleaning container 24 and communicates with the concave portion 71*d*1 of the elastomer member forming portion 71*d* is provided.

Next, a method of molding the elastomer member 10 will be described.

In the present embodiment, as shown in FIGS. 9A and 9B, the inlet 76 is provided at one position in the central portion of the elastomer member forming portion 71*d* in the longitudinal direction, but the inlets 76 may also be provided at two or more positions.

As shown in FIGS. 9A and 9B, when the elastomer member 10 is molded, the elastomer mold 83 that is carved so as to have the shape of the elastomer member 10 is caused to abut on the abutment surfaces 71*d*2 and 71*d*3 of the elastomer member forming portion 71*d* of the cleaning container 24. Next, a gate 82 of a resin injection apparatus is caused to abut on the inlet 76 provided in the cleaning container 24. Subsequently, a thermoplastic elastomer that will become the elastomer member 10 is injected into the inlet 76 of the cleaning container 24 from the gate 82 of the resin injection apparatus as indicated by an arrow in FIG. 9C. As a result, the thermoplastic elastomer is flown into a molding space formed by the concave portion 71*d*1 of the elastomer member forming portion 71*d* of the cleaning container 24 and the elastomer mold 83 (injection). As shown in FIGS. 11A and 11B, the thermoplastic elastomer injected from one position in the central portion in the longitudinal direction flows to both sides in the longitudinal direction in the space formed by the concave portion 71*d*1 of the elastomer member forming portion 71*d* and the elastomer mold 83.

The elastomer member 10 is molded integrally with the cleaning container 24. In the present embodiment, a styrene-based elastomer resin is used as the material of the elastomer member 10. This is because, since the cleaning container 24 is formed of a high impact polystyrene (HI-PS), it is possible to perform reproduction of the material (crush→re-pellet) without performing disassembly when the cartridge is recycled by using the material of the same base. However, another elastomer resin other than the above material may also be used as long as the elastomer resin has similar mechanical characteristics.

The method of molding the elastomer member 10 in the cleaning container 24 has been described thus far, and the present embodiment can also be applied to the case where the elastomer member 11 is molded in the developing container 71. Further, in addition to the molding method of the present embodiment, the elastomer member may also be molded in the cleaning container 24 or the developing container 71 by two-color molding, insert molding and the like.

(Welding of Sheet)

Figure 12A:
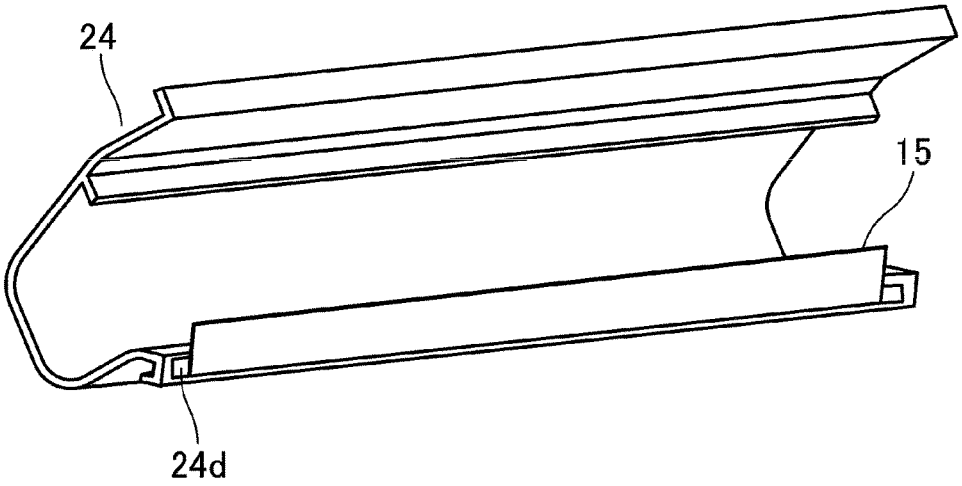
FIG. 12A is an explanatory view of the state of the cleaning container to which a sheet is attached.
Figure 12B:
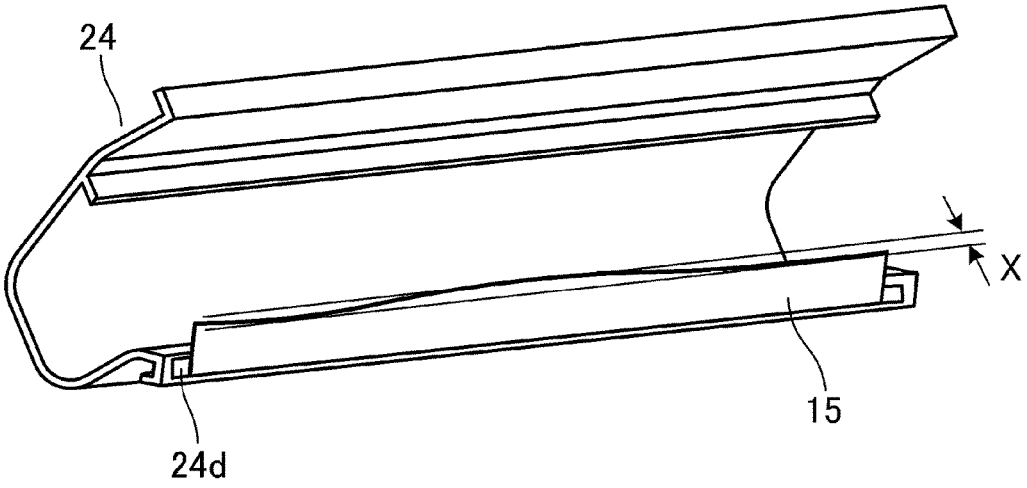
FIG. 12B is an explanatory view of a tip undulation of the sheet.
Figure 13A:
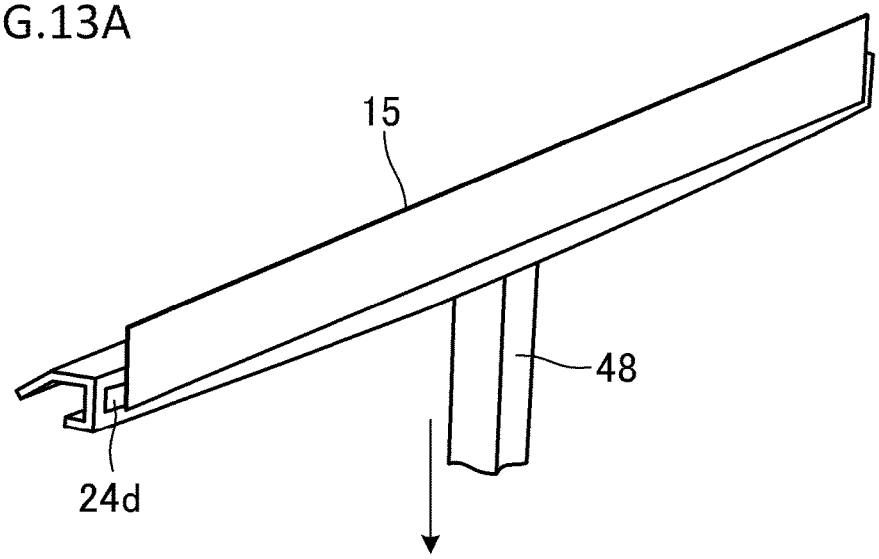
FIG. 13A is a view showing a state in which a sheet attachment surface of the cleaning container to which the sheet is attached is curved.
Figure 13B:
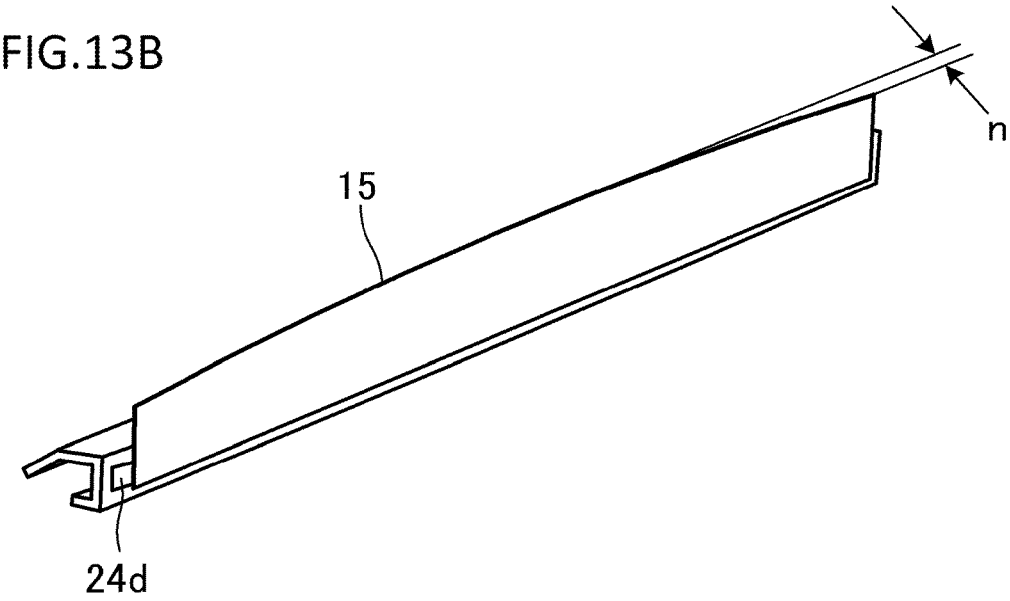
FIG. 13B is a view showing a state in which tension is applied to the upper end of the sheet.

The step of welding the sheet of the present invention will be described by using the case where a semiconductor laser is used as an example by using FIGS. 12A to 17. FIG. 12A is an explanatory view of the state of the cleaning container 24 to which the sheet 15 is attached. FIG. 12B is an explanatory view of the state of the cleaning container 24 in which the tip of the sheet 15 attached according to the present invention is undulated. FIG. 13A is an explanatory view of a state in which a sheet attachment surface 24*d* of the cleaning container 24 to which the sheet is attached is curved using a pulling jig 48. FIG. 13B is an explanatory view of a state in which the curve of the sheet attachment surface 24*d* of the cleaning container 24 is released and tension is applied to the upper end of the sheet 15.

Figure 14:
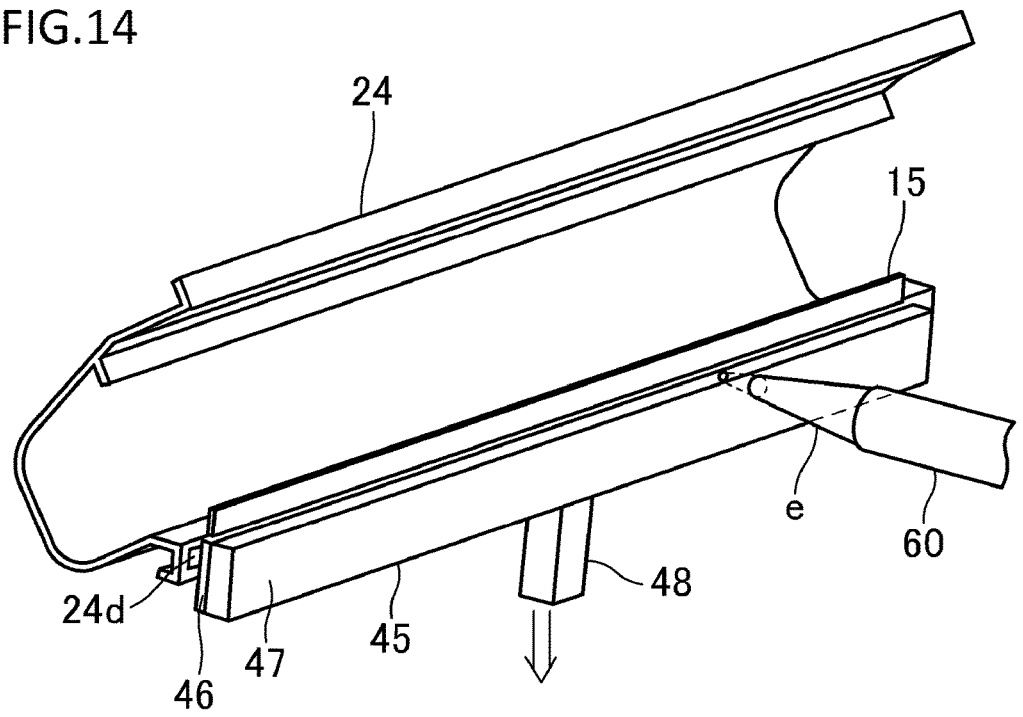
FIG. 14 is an explanatory view showing a state in which the elastomer member molded in the cleaning container is melted and the sheet is welded.
Figure 15:
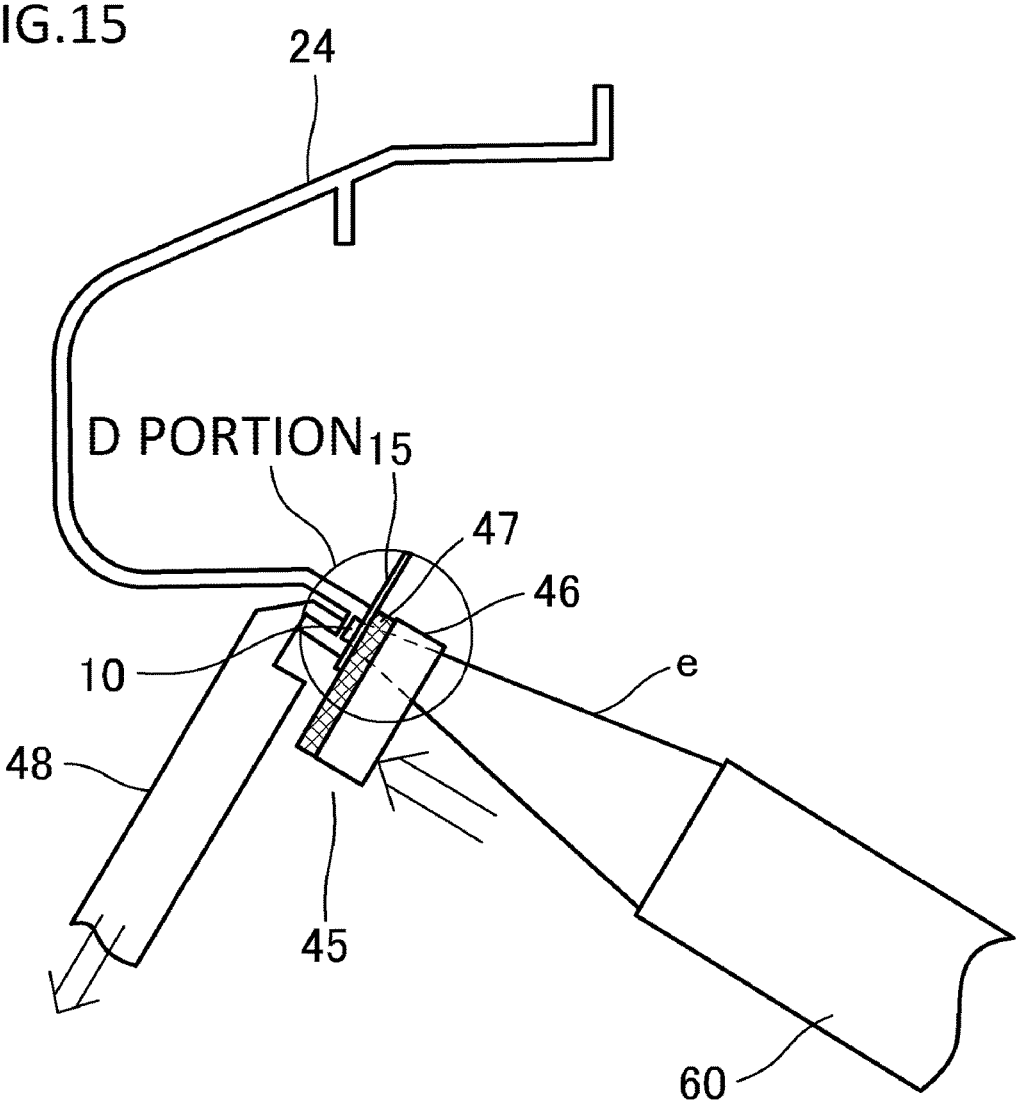
FIG. 15 is a cross-sectional view of FIG. 14.
Figure 16:
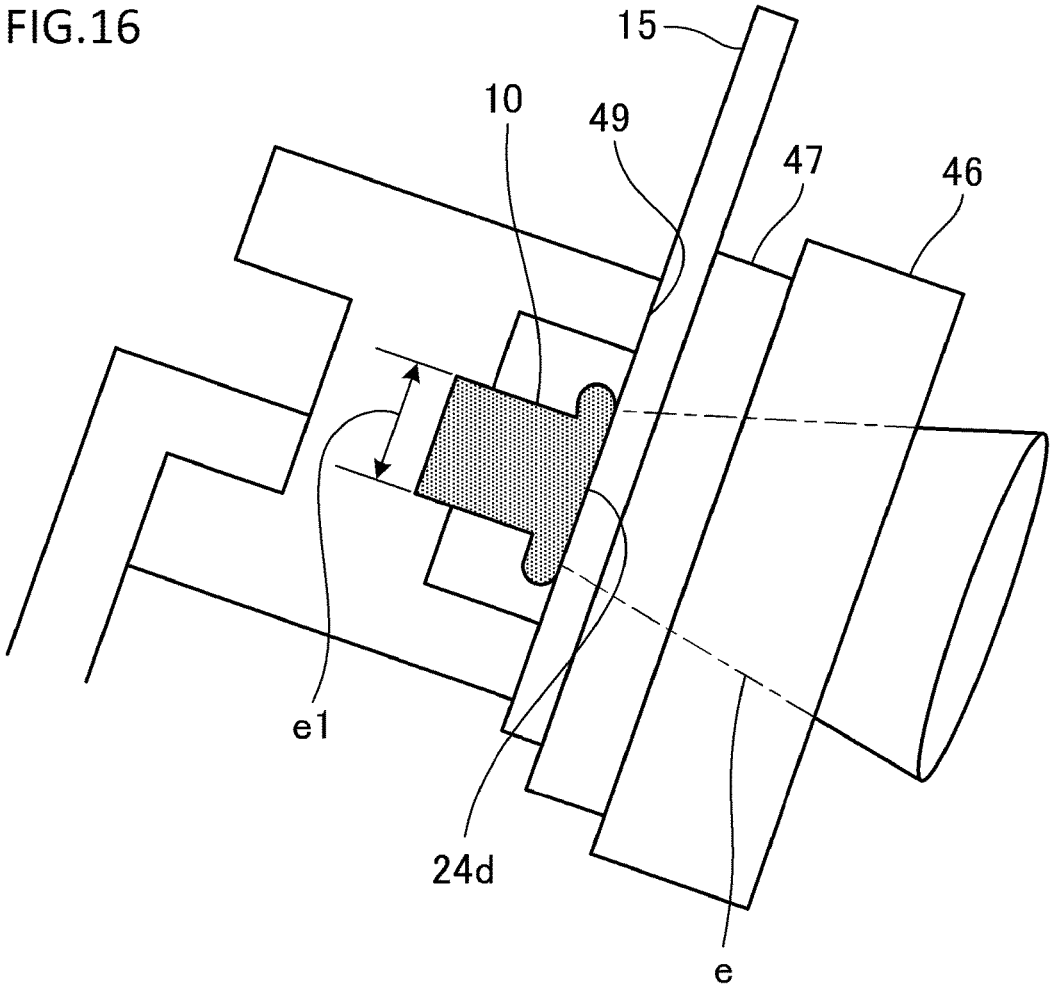
FIG. 16 is a partially enlarged view of FIG. 15.
Figure 17:
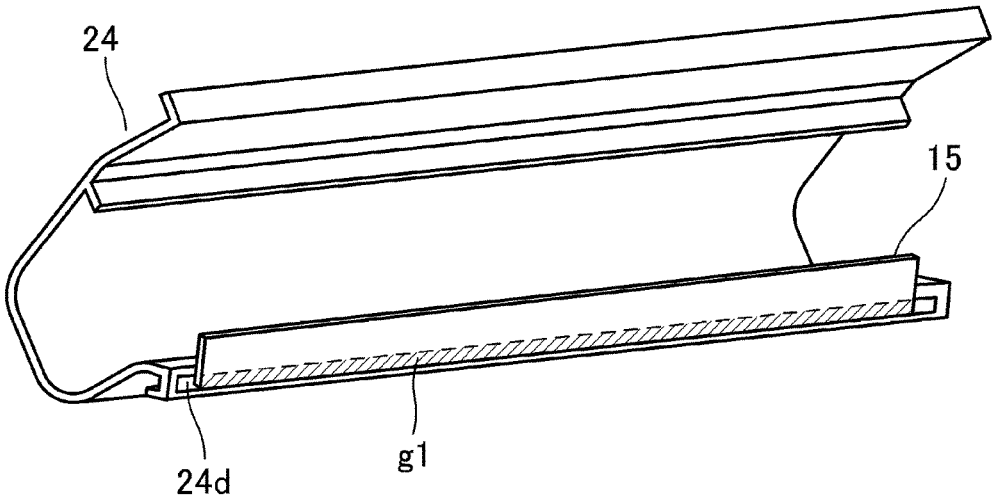
FIG. 17 is an explanatory view showing the cleaning container to which the sheet is welded.

FIG. 14 is an explanatory view showing a state in which the elastomer member 10 molded in the cleaning container 24 is melted and the sheet 15 is welded. FIG. 15 is a cross-sectional view of the state of FIG. 14. FIG. 16 is a partially enlarged view of FIG. 15. FIG. 17 is an explanatory view showing the cleaning container 24 to which the sheet 15 is welded according to the present invention. Note that the sheet 15 that has a thickness of 38 μm and a light transmittance of 85% (in near-infrared light of 960 nm), and is formed of polyester is used.

First, as shown in FIG. 12A, the cleaning container 24 is prepared.

At this point, there are cases where an undulation x shown in FIG. 12B occurs at the tip of the sheet 15 (a contact portion with the image carrier 21) due to a wrinkle of the sheet itself or environmental changes. Accordingly, as shown in FIG. 13A, when the sheet 15 is attached, a force receiving portion of the sheet attachment surface 24*d* of the cleaning container 24 is pulled downward using the pulling jig 48. The cleaning container 24 is curved with an elastic deformation at this point, and the curve is released after the sheet 15 is attached in this state. Thus, by attaching the sheet 15 in the state in which the cleaning container 24 is curved, it is possible to give an initial tension amount n to the tip of the sheet 15 with the elastic force of the cleaning container 24 as shown in FIG. 13B, and prevent the occurrence of the undulation. In the present embodiment, as shown in FIGS. 14 to 16, in the state in which the cleaning container 24 is curved by using the pulling jig 48, the sheet 15 is placed so as to be in contact with the sheet attachment surface 24*d* of the elastomer member 10 molded in the cleaning container 24. Subsequently, pressurization is performed from above the sheet 15 such that the sheet 15 comes into contact with sheet position regulating surfaces 49 that regulate the sheet position by using a pressing jig 45 having permeability to the near-infrared light. With this, temporary positioning is performed such that the disposition of the sheet 15 relative to the cleaning container 24 is not displaced when the sheet 15 is adhered.

Thereafter, near-infrared laser light e is emitted from an irradiation head 60 to the side of the sheet attachment surface 24*d* of the elastomer member 10 molded in the cleaning container 24 through the sheet 15. The elastomer member 10 contains carbon black in order to absorb the near-infrared light. Accordingly, the emitted laser light e passes through the pressing jig 45 having permeability to the near-infrared light and the sheet 15, and is absorbed in the sheet attachment surface 24*d* of the elastomer member 10 molded in the cleaning container 24.

The laser light absorbed in the sheet attachment surface 24*d* is converted to heat, the sheet attachment surface 24*d* radiates heat, the elastomer member 10 is melted by the heat, and it becomes possible to weld (adhere) the elastomer member 10 to the sheet 15 that is in contact with the sheet attachment surface 24*d*.

Herein, the laser light e emitted from the irradiation head 60 is condensed so as to be formed into a circle having a diameter ϕ of 1.5 mm when the laser light e reaches the sheet attachment surface 24*d*. That is, the spot diameter ϕ of the laser is 1.5 mm. It becomes possible to uniformly melt the sheet attachment surface 24*d* of the elastomer member 10 by reducing the molding width of the elastomer member to a width less than 1.5 mm. Consequently, in the present embodiment, the melt width e1 of the elastomer member 10 is about 1.0 mm. The laser light is continuously emitted to an area from one end portion to the other end portion of the sheet 15 in the longitudinal direction. With this, it becomes possible to obtain a welding surface g1 that is continuously extended in the longitudinal direction, as shown in FIG. 17.

Note that, in the present embodiment, as the irradiation apparatus of the near-infrared light, FD200 manufactured by Fine Device Co., Ltd (wavelength: 960 nm) was used. The scanning speed of the near-infrared light irradiation apparatus in the longitudinal direction was set to 50 mm/sec, the output thereof was set to 20 W, and the spot diameter ϕ thereof on the surface of the elastomer member was set to 1.5 mm. In addition, the energy density on the surface of the elastomer member 10 was set to 0.22 J/mm$^2$. Further, as the material of the elastomer member 10, a material having 100 parts by mass of the styrene-based elastomer resin containing 3.0 parts by mass of carbon black having a number-average particle size of 16 nm was used.

As the pressing jig 45, it is preferable to use a member that has permeability to the laser light e and has stiffness that allows the pressurization of the entire area of the contact surface between the sheet 15 and the sheet attachment surface 24*d* of the elastomer member 10. Specifically, it is preferable to use an acrylic resin, glass and the like. In the present embodiment, as the pressing jig 45, the one obtained by sticking an acrylic member 46 as a member having the stiffness to silicon rubber having a thickness of 5 mm serving as an elastic pressing member 47 with a double-sided adhesive tape having permeability was used.

The cleaning container 24 in which the elastomer member 10 having the sheet attachment surface 24*d* is molded is formed of a resin material, and there are cases where the sheet attachment surface 24*d* is curved and a small projection or depression or a slight deformation occurs when the sheet 15 is attached. In addition, there are cases where the position of the sheet 15 relative to the cleaning container 24 is displaced. To cope with this, in the present embodiment, the elastic body is used as the pressing member 47, and the sheet 15 is pressed against the cleaning container 24 and is temporarily positioned, whereby adherence between the sheet 15 and the sheet attachment surface 24*d* is improved. Further, the positional displacement of the sheet 15 is thereby prevented.

The method of adhering the sheet 15 to the elastomer member 10 molded in the cleaning container 24 has been described thus far, and the present embodiment can also be applied to the welding of the sheet 16 to the elastomer member 11 molded in the developing container 71. Further, the sheet 15 having the light transmittance of 85% is used in the present embodiment, but it is also possible to perform the welding with a sheet member (thin plate member) having the light transmittance of 85% or less. Furthermore, in addition to the welding method of the present embodiment, the elastomer member 10 and the sheet 15 may be welded to each other with a heat seal or the like, and the sheet 15 may also be directly stuck to the elastomer member 10 in the case where the elastomer member 10 has adequate tackiness.

Further, by making the welding strength between the sheet 15 and the elastomer member 10 higher than the adherence strength between the elastomer member 10 and the cleaning container 24, it becomes possible to peel the sheet 15 and the elastomer member 10 from the cleaning container 24 at the same time in the subsequent disassembly step.

This can also be applied to the welding of the sheet 16 to the elastomer member 11 molded in the developing container 71.

Hereinbelow, the cartridge reproduction method of the present invention (a method of manufacturing a new cartridge by using an old cartridge) will be described.

Figure 18:
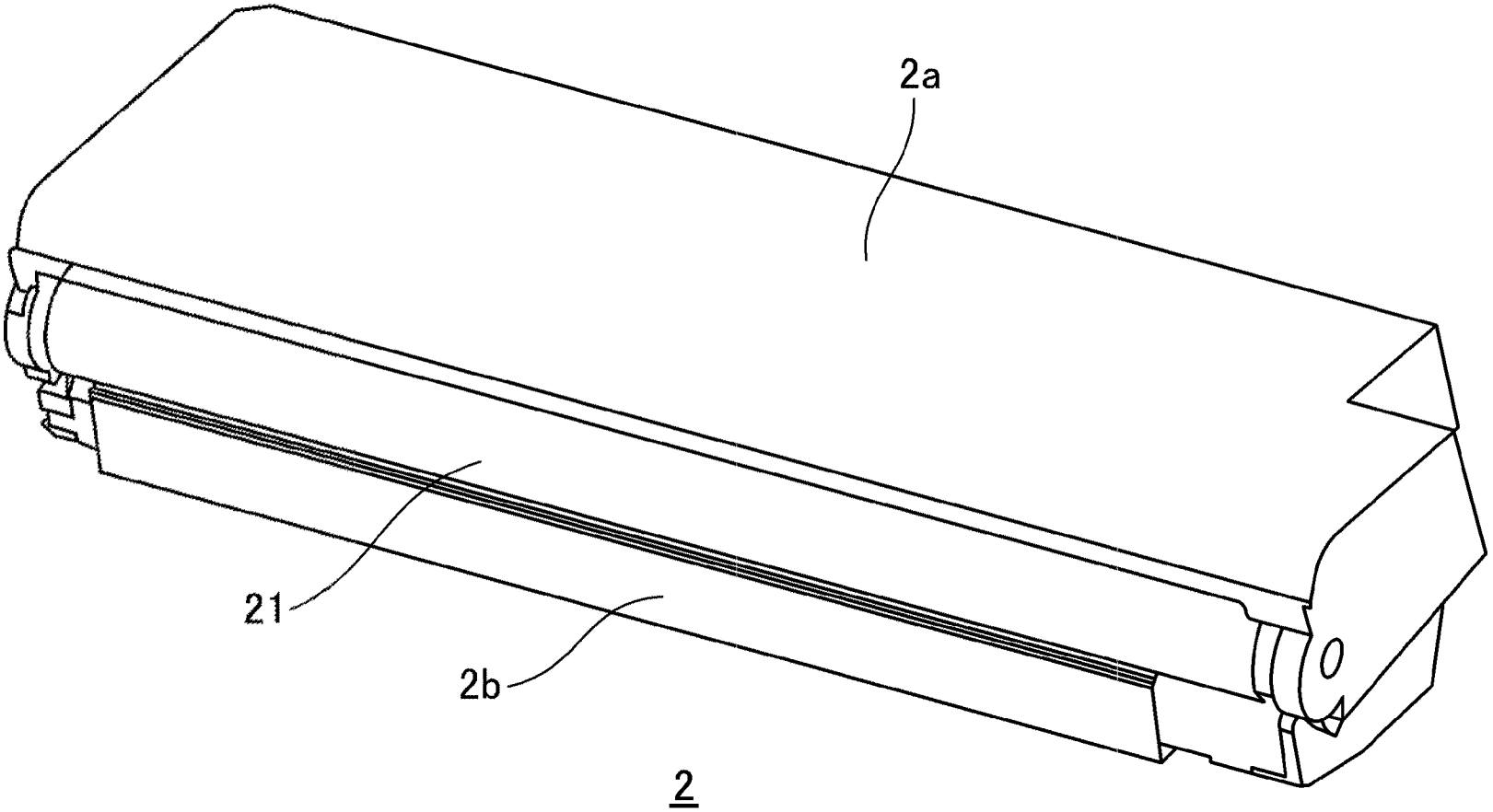
FIG. 18 is a schematic view of a cartridge.

FIG. 18 is a schematic view of the cartridge. As shown in the drawing, the cartridge (old cartridge) 2 in which the toner is used up is collected and reproduced by a reproduction step. In the reproduction step, a component resulting from disassembly is inspected and is appropriately replaced with a new component when the component is rejected, whereby the reproduction is performed. At this point, in the case where the flexible sheet member (thin plate member) such as the sheet 15 or the sheet 16 that prevents the toner leakage is undulated or peeled, the replacement of the sheet member is performed (re-fixation of the sheet member).

(Disassembly step of cleaning unit and developing unit)

First, the cartridge 2 is disassembled into the cleaning unit 2*a* and the developing unit 2*b* (not shown). Herein, each of the cleaning unit 2*a* and the developing unit 2*b* has the sheet member for sealing the toner and, in the present embodiment, the description will be made by taking the case of the sheet 15 as the flexible sheet member of the cleaning unit 2*a* as an example.

That is, the cartridge 2 has the image carrier 21 as the rotator, the cleaning container 24 as the frame that supports the image carrier 21, the elastomer member 10 that is provided in a concave portion 31 formed in the cleaning container 24 along a rotation axis direction of the image carrier 21, and the sheet 15 as the thin plate member that has one end fixed to the elastomer member 10 and the other end abutting on the image carrier 21 along the rotation axis direction.

The cleaning container 24 is a container that accommodates the toner as the developer removed from a portion on the image carrier 21. The sheet 15 is a flexible sheet member that abuts on the image carrier 21, scoops the toner removed from the image carrier 21, and causes the cleaning container 24 to accommodate the scooped toner.

As the reproduction method, hereinbelow, five Embodiments 1 to 5 will be described.

The step of detaching the image carrier 21, the sheet 15, and the elastomer member 10 is common to Embodiments 1 to 5, and the method of re-fixing the sheet 15 differs from one embodiment to another.

First, the common step of detaching the image carrier 21, the sheet 15, and the elastomer member 10 will be described.

Step common to Embodiments 1 to 5 (Step of detaching image carrier 21, sheet 15, and elastomer member 10)

Figures 19A, 19B:
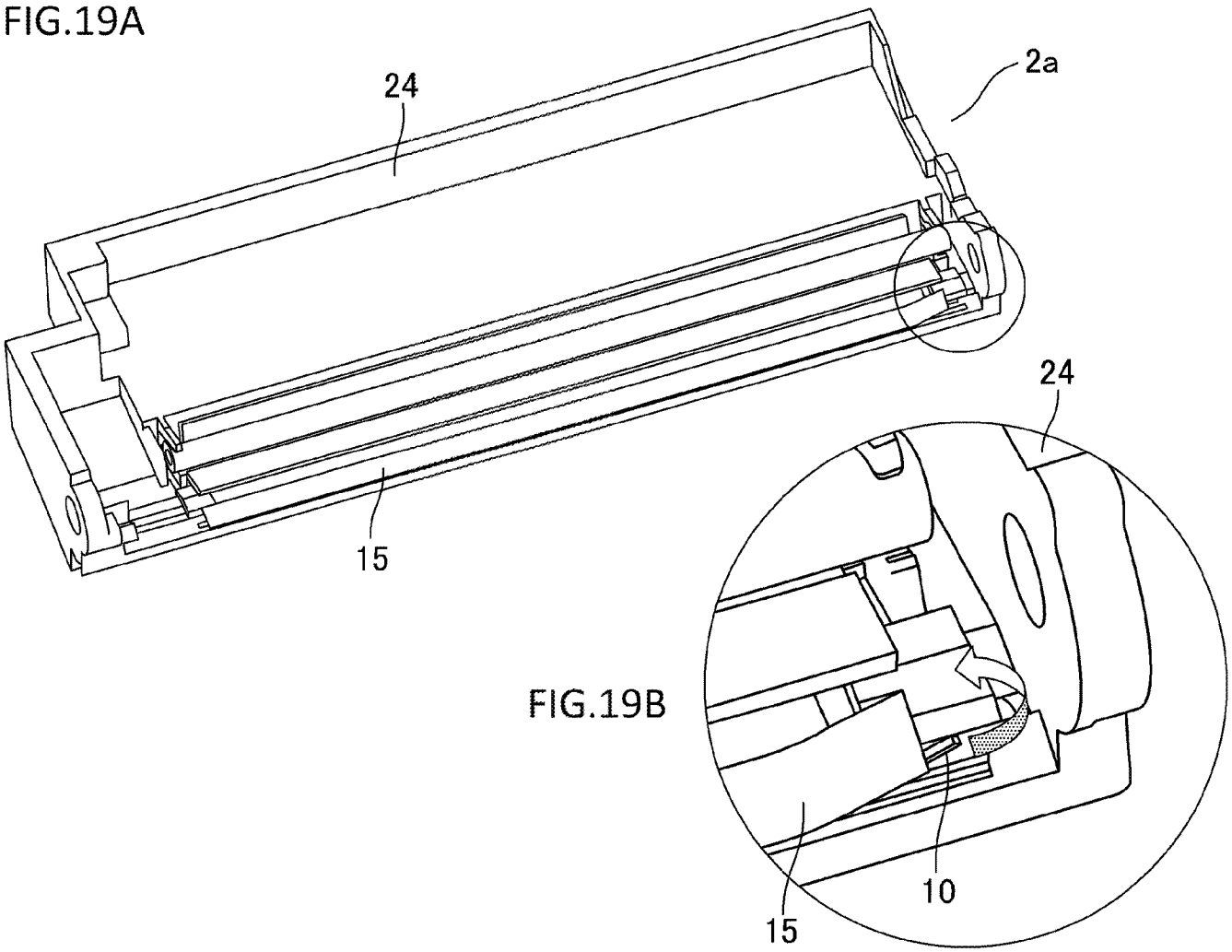
FIG. 19A is an explanatory view of detachment of the sheet and the elastomer member from the cleaning container.
FIG. 19B is an enlarged view of a principal portion.

FIGS. 19A and 19B are explanatory views of the step of detaching the sheet 15 and the elastomer member 10 from the cleaning container 24.

First, the image carrier 21 is detached from the cleaning container 24 as the frame (step of detaching the image carrier 21). This step is not shown, in particular, in the drawing, and it is possible to detach the image carrier 21 at a stage in which the cleaning container 24 is disassembled.

FIGS. 19A and 19B show the step of detaching the sheet 15 as the thin plate member before reproduction from the cleaning container 24 as the frame and the step of detaching the elastomer member 10 from the cleaning container 24.

As shown in FIGS. 19A and 19B, in the detachment of the sheet 15, the sheet 15 and the elastomer member 10 are detached from the cleaning container 24 manually or by using a tool (pliers, tweezers, etc.). That is, the sheet 15 as the thin plate member before reproduction is detached from the cleaning container 24 as the frame and, further, the elastomer member 10 is detached from the cleaning container 24.

In the present embodiment, when the sheet 15 is peeled from the cleaning container 24, the elastomer member 10 is detached from the cleaning container 24 integrally with the sheet 15 in a state in which the elastomer member 10 is attached to the side of the sheet 15 (the side of the thin plate member). Unlike the present embodiment, in the case where the elastomer member 10 cannot be detached concurrently with the detachment of the sheet 15, it is preferable to remove the elastomer member 10 separately. However, even when part of the elastomer member 10 remains, no problem is presented depending on the method of attaching an adhesive member described later.

With the arrangement described above, the step of detaching the image carrier 21 and the step of detaching the sheet 15 and the elastomer member 10 are ended.

Hereinbelow, the step of attaching the adhesive member and the step of attaching a new sheet (another sheet) of each of Embodiments 1 to 5 will be described.

Embodiment 1

FIGS. 20A to 21C show Embodiment 1.

In Embodiment 1, a new sheet (another sheet different from the sheet 15) 17 is attached to adhesive member attachment portions 29 formed at both side edge portions in a lateral direction X of the concave portion 31 in which the elastomer member 10 is provided via a double-sided adhesive tape 18. The sheet 17 is a flexible member that prevents the toner leakage (developer leakage) to the outside.

The double-sided adhesive tape 18 is configured separately from the sheet 17, and Embodiment 1 has the step of attaching the double-sided adhesive tape 18 and the step of sticking the new sheet 17 to the double-sided adhesive tape 18.

(Step of Attaching Double-Sided Adhesive Tape)

Figures 20A, 20B, 20C:
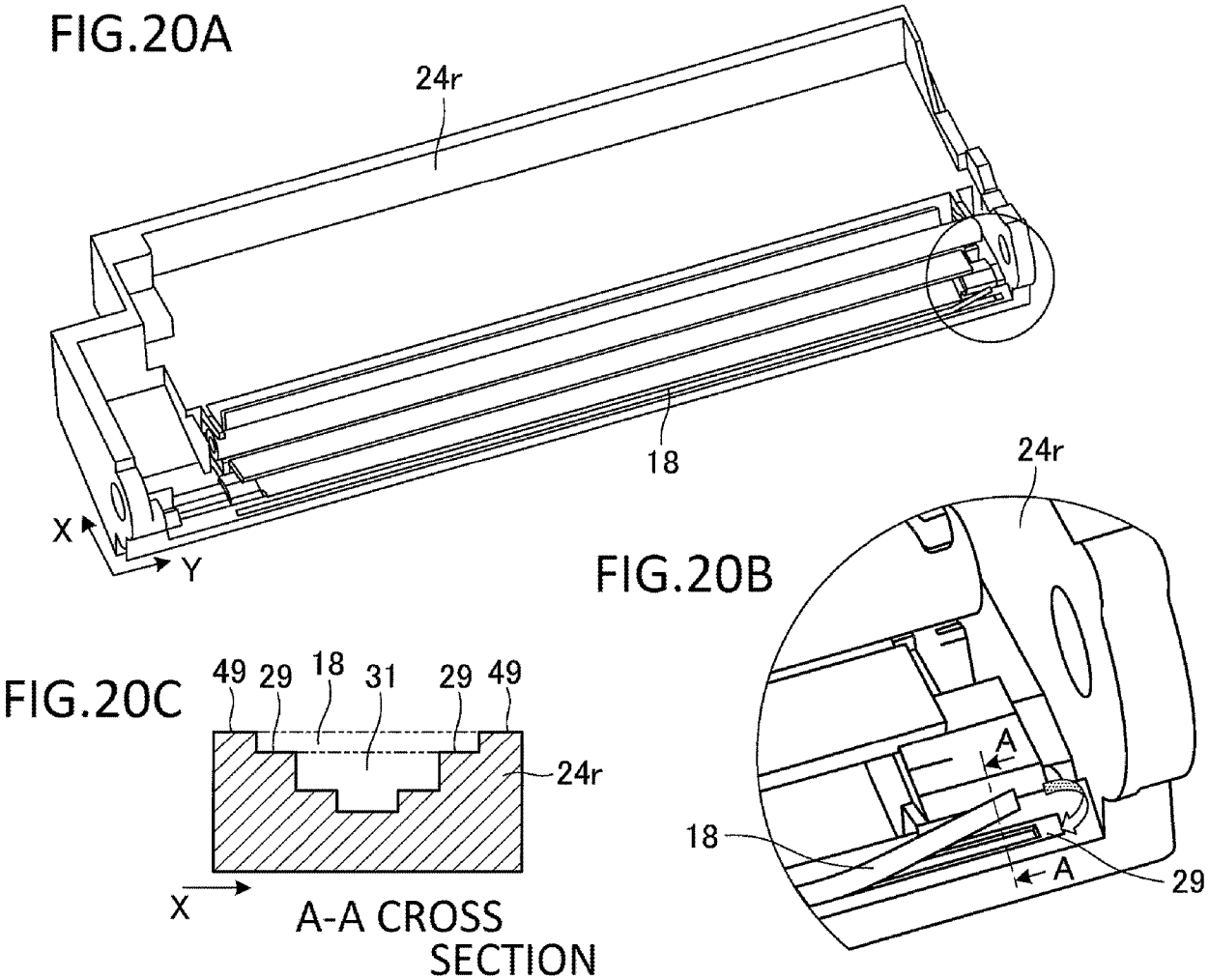
FIG. 20A is an explanatory view of attachment of a double-sided adhesive tape of Embodiment 1.
FIG. 20B is an enlarged view of a principal portion.
FIG. 20C is an enlarged cross-sectional view taken along the line A-A of FIG. 20B.

FIG. 20A is an explanatory view of the step of sticking the double-sided adhesive tape 18, FIG. 20B is a partially enlarged view of FIG. 20A, and FIG. 20C is a schematic cross-sectional view of the adhesive member attachment portion 29.

First, the double-sided adhesive tape 18 as the adhesive member is attached to the adhesive member attachment portions 29 formed in the cleaning container 24 so as to be arranged side by side in the lateral direction X of the concave portion 31 in which elastomer member 10 is provided. The double-sided adhesive tape 18 has sticky materials on both sides thereof. The lateral direction of the concave portion 31 is a direction orthogonal to the rotation axis of the image carrier 21.

The cross section of the concave portion 31 is substantially rectangular, and both side edge portions of the concave portion 31 in the lateral direction are angular portions between the inner side surface of the concave portion 31 and the sheet position regulating surfaces 49, and are formed by providing stepped portions which are one step lower than the sheet position regulating surfaces 49 by a length corresponding to the thickness of the double-sided adhesive tape 18 in the angular portions (see FIG. 20C). The adhesive member attachment portion 29 may be formed by providing an additional formation step at the time of reproduction, and no problem is presented even when the adhesive member attachment portion 29 is formed in advance before the reproduction.

(Step of Attaching Sheet)

Figure 21A:
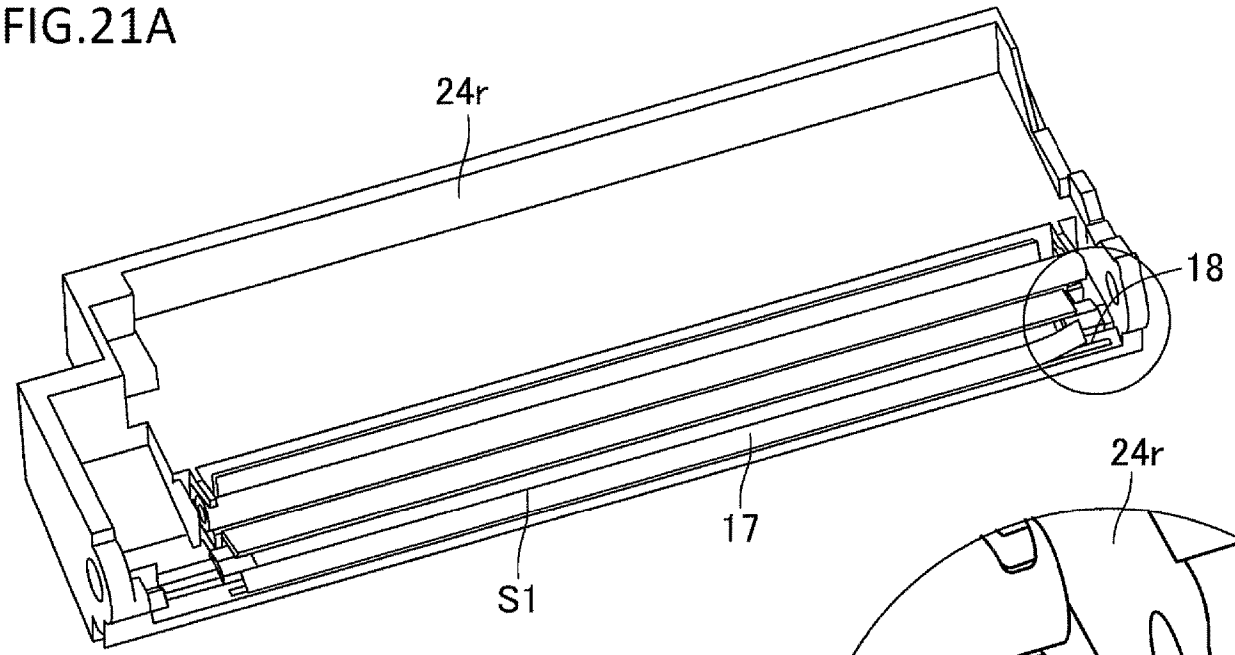
FIG. 21A is an explanatory of attachment of the sheet of Embodiment 1.
Figure 21B:
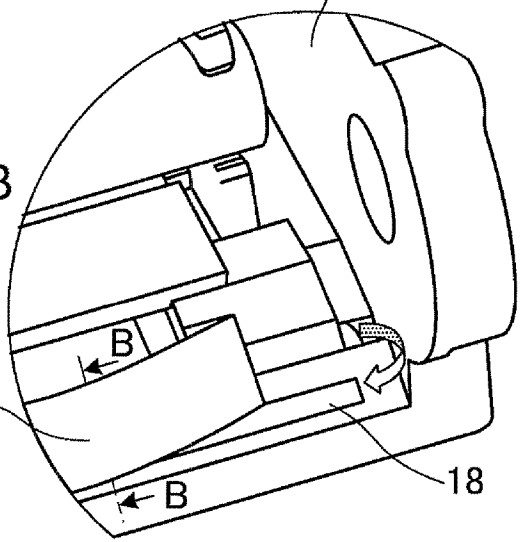
FIG. 21B is an enlarged view of a principal portion.
Figure 21C:
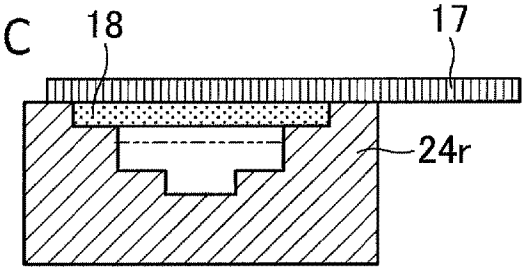
FIG. 21C is an enlarged cross-sectional view taken along the line B-B of FIG. 21B.
Figure 22:
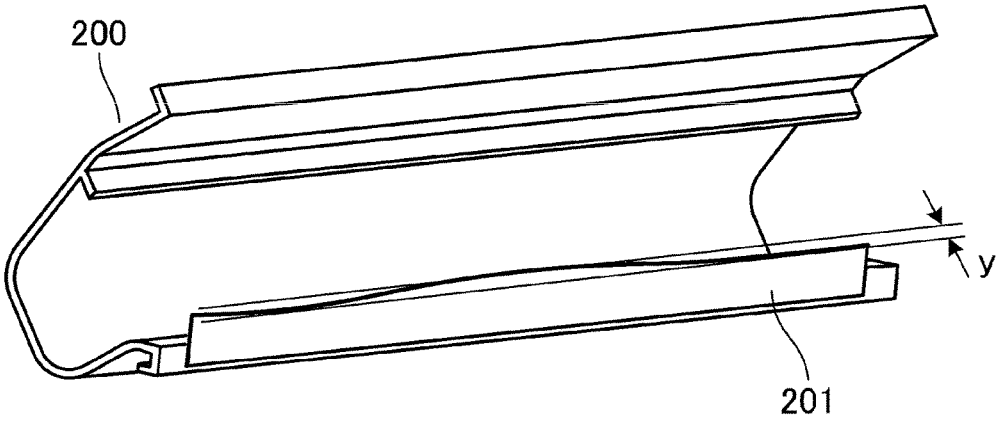
FIG. 22 is a schematic view of an undulation of a sheet member.

FIG. 21A is an explanatory view of attachment of the sheet 17 to a cleaning container 24*r*, FIG. 21B is an enlarged view of a portion to which the sheet 17 is attached, and FIG. 21C is a schematic cross-sectional view of a state in which the sheet 17 is attached.

That is, the sheet 17 is stuck to the double-sided adhesive tape 18 attached to the adhesive member attachment portions 29 (see FIGS. 21A and 21B). At this point, the sheet 17 is attached manually or by using a tool such that a tip 51 of the sheet 17 is not undulated.

As the adhesive member, in addition to the double-sided adhesive tape, it is possible to use a melted resin such as a hot-melt adhesive or a liquid adhesive member.

The basic configuration of the thus reproduced (newly manufactured) cartridge is a configuration in which the sheet 15 of the cartridge of FIG. 2 is replaced with the sheet 17. To describe the configuration by using FIG. 2, the configuration includes the cleaning container 24 as the frame that includes the storage space serving as a toner storage portion, and the image carrier 21 as the rotator that is provided in the opening portion of the cleaning container 24 so as to be rotatable with respect to the cleaning container 24. In addition, the sheet 17 attached to the cleaning container 24 is configured to abut on the image carrier 21 to prevent the leakage of the toner from between the cleaning container 24 and the image carrier 21. The sheet position of the sheet 17 is positioned by the sheet position regulating surfaces 49, and the disposition of the sheet 17 relative to the cleaning container 24 is prevented from being displaced.

As described above, the concave portion 31 is formed in the surface of the cleaning container 24 to which the sheet 17 is attached, and the sheet 17 is stuck and fixed to the adhesive member attachment portions 29 arranged in the lateral direction of the concave portion 31 via the adhesive member 18. Note that, in the present embodiment, the sheet 17 is stuck to the cleaning container 24 with the double-sided adhesive tape 18 after the double-sided adhesive tape 18 is stuck to the cleaning container 24. However, the present embodiment is not limited thereto, and the sheet 17 may also be stuck to the cleaning container 24 with the double-sided adhesive tape 18 after the double-sided adhesive tape 18 is stuck and fixed to the sheet 17.

Embodiment 2

Next, Embodiment 2 will be described with reference to FIGS. 23A to 24C. Note that, in the following embodiment, the description of the same configuration as that of Embodiment 1 will be omitted and points different from Embodiment 1 will be mainly described.

Embodiment 2 has the step of filling at least part of a concave portion 300 in which an elastomer member (elastic member) 10*b* is formed with an adhesive member 318*a* as a filling member, and the step of sticking another sheet 170*b* different from the sheet 15 with the adhesive member 318*a*. The sheet 170*b* is a flexible member that prevents the toner leakage (developer leakage) to the outside.

(Step of Attaching Adhesive Member)

FIGS. 23A to 23D show the step of attaching the adhesive member 318*a*.

Figures 23A, 23B, 23C, 23D:
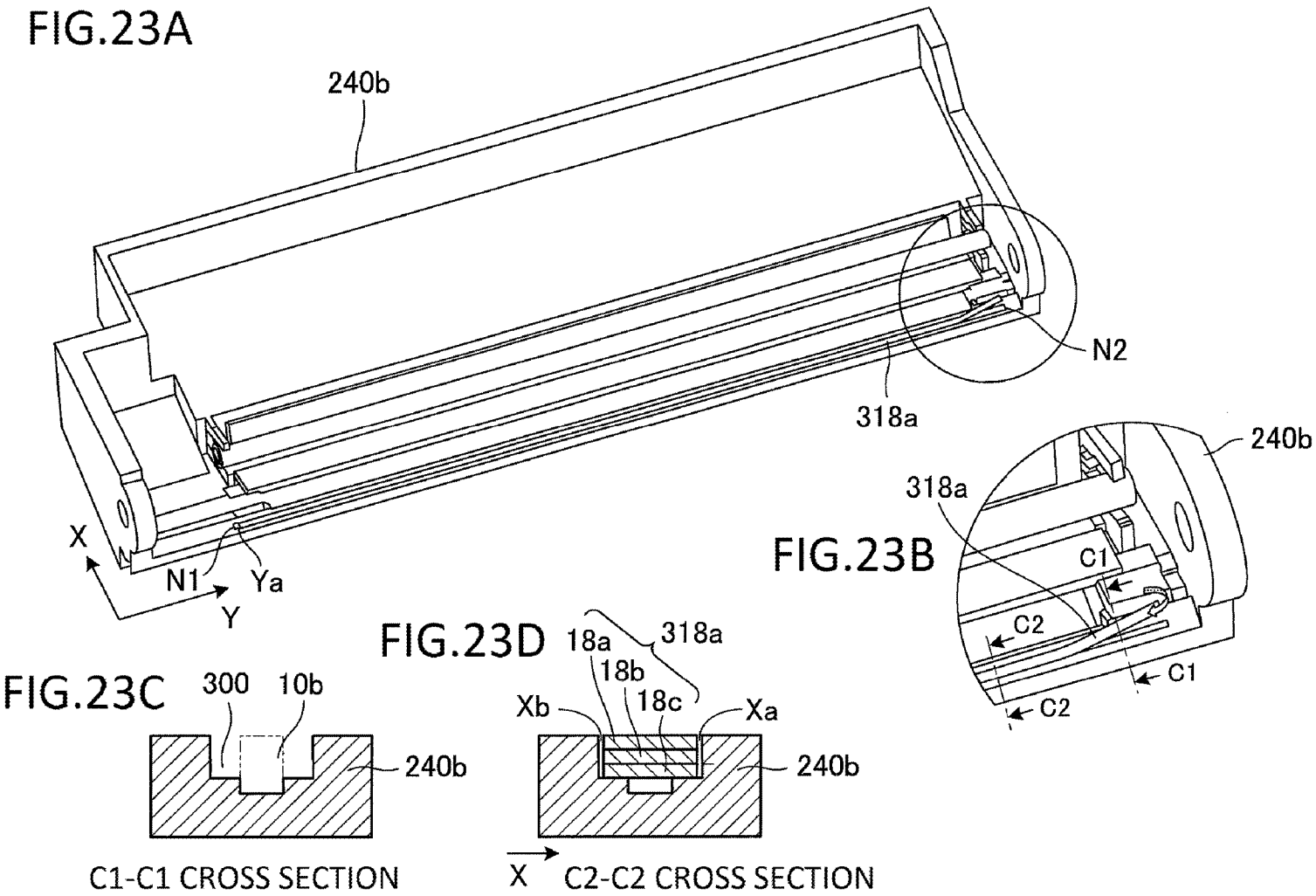
FIG. 23A is an explanatory view of a state in which an adhesive member of Embodiment 2 is attached.
FIG. 23B is an enlarged view of a principal portion.
FIG. 23C is an enlarged cross-sectional view taken along the line C1-C1 of FIG. 23B.
FIG. 23D is an enlarged cross-sectional view taken along the line C2-C2 of FIG. 23B.

FIG. 23A is an explanatory view of attachment of the adhesive member 318*a* to a cleaning container 240*b*, and FIG. 23B is an enlarged view of a portion to which the adhesive member 318*a* is attached. FIG. 23C is a schematic cross-sectional view showing a concave portion 300 in which the elastomer member 10*b* is formed. FIG. 23D is a schematic cross-sectional view of a state in which a plurality of double-sided adhesive tapes 18*a*, 18*b*, and 18*c* are stacked on each other and attached as the adhesive member 318*a*.

That is, the adhesive member 318*a* is attached so as to fill the concave portion 300 of the cleaning container 240*b* (see FIGS. 23A and 23B). At this point, it is preferable to attach the adhesive member 318*a* continuously in the longitudinal direction Y from the viewpoint of prevention of the toner leakage. A gap Ya and the like may be formed at one end portion N1 and the other end portion N2 of the adhesive member 318*a* in the longitudinal direction (see FIG. 23A). In addition, in the lateral direction X, gaps Xa and Xb may be formed (see FIG. 23D). It goes without saying that no problem is presented when the concave portion 300 is completely filled.

As shown in FIG. 23D, the adhesive member 318*a* is a member obtained by stacking the plurality of the double-sided adhesive tapes 18*a*, 18*b*, and 18*c* on each other. However, when the double-sided adhesive tape has a sufficient thickness, it is not necessary to stack them.

(Step of Attaching Sheet)

Next, the step of attaching the sheet 170*b* will be described by using FIGS. 24A to 24C.

Figure 24A:
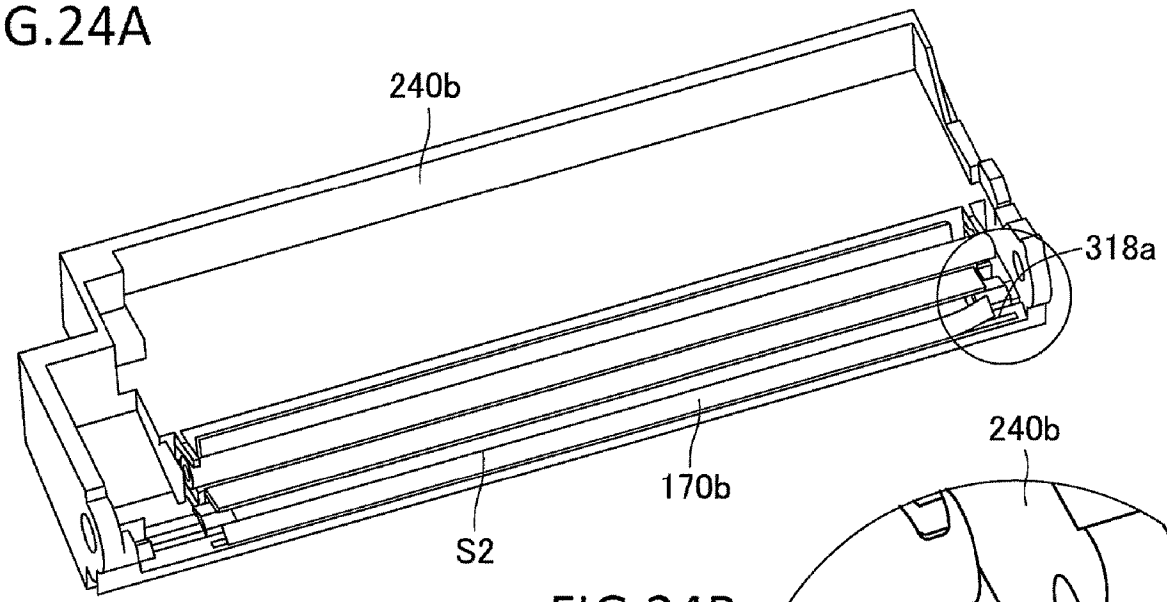
FIG. 24A is an explanatory view of attachment of the sheet of Embodiment 2.

FIG. 24A is an explanatory view of attachment of the sheet 170*b* to the cleaning container 240*b*. FIG. 24B is an enlarged view of a portion to which the sheet 170*b* is attached. FIG. 24C is a schematic cross-sectional view of the portion to which the sheet 170*b* is attached.

Figure 24B:
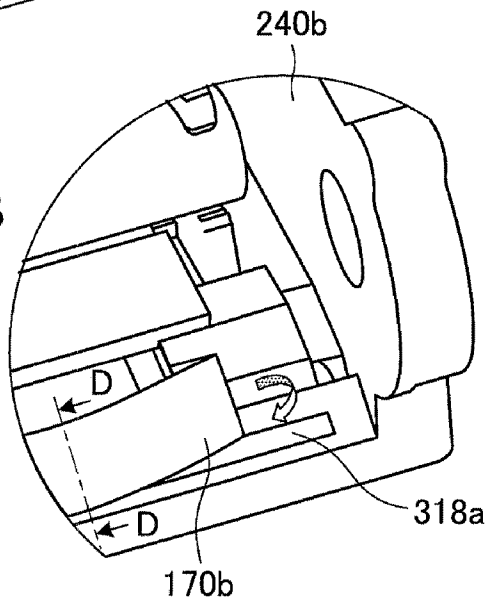
FIG. 24B is an enlarged view of a principal portion.
Figure 24C:
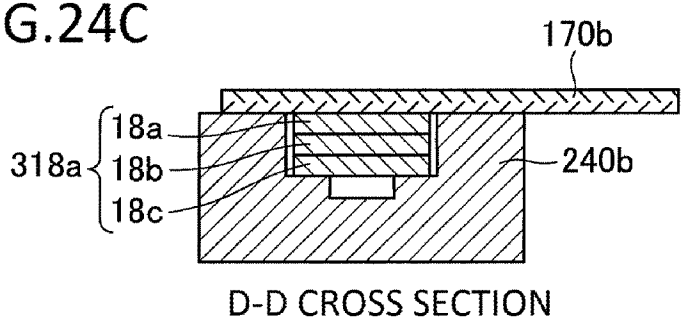
FIG. 24C is an enlarged cross-sectional view taken along the line D-D of FIG. 24B.

As shown in FIGS. 24A and 24B, the sheet 170*b* is attached to the adhesive member 318*a* shown in FIG. 24C. At this point, the sheet 170*b* is attached manually or by using a tool such that a tip S2 of the sheet 170*b* shown in FIG. 24A is not undulated.

The basic configuration of the thus reproduced (newly manufactured) cartridge is a configuration in which the sheet 15 of the cartridge of FIG. 2 is replaced with the sheet 170*b*. To describe the configuration by using FIG. 2, the configuration includes the cleaning container 24 as the frame that includes the storage space serving as the toner storage portion, and the image carrier 21 as the rotator that is provided in the opening portion of the cleaning container 24 so as to be rotatable with respect to the cleaning container 24. In addition, the sheet 170*b* attached to the cleaning container 24 is configured to abut on the image carrier 21 to prevent the leakage of the toner from between the cleaning container 24 and the image carrier 21. The sheet position of the sheet 170*b* is positioned by the sheet position regulating surfaces 49, and the disposition of the sheet 170*b* relative to the cleaning container 24 is prevented from being displaced.

As described above, the concave portion 300 is formed in the surface to which the sheet 170*b* is attached, and the sheet 170*b* is fixed using at least part of the concave portion 300, i.e., the adhesive member 318*a* as the filling member in this embodiment.

Embodiment 3

Next, Embodiment 3 will be described with reference to FIGS. 25A to 25C.

Figure 25A:
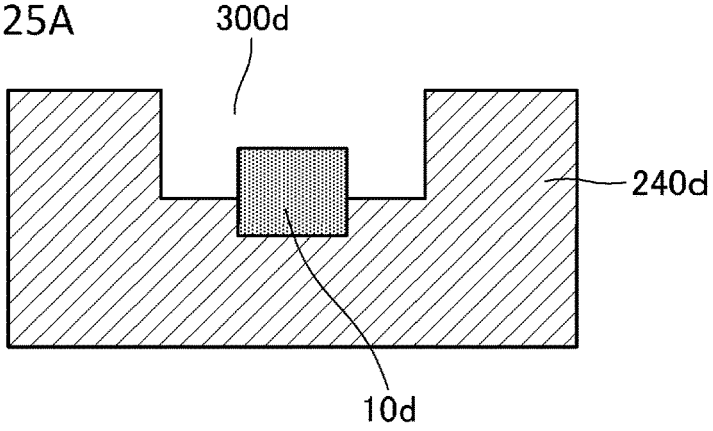
FIGS. 25A and 25B are schematic cross-sectional views when the adhesive member of Embodiment 3 is applied.
Figure 25B:
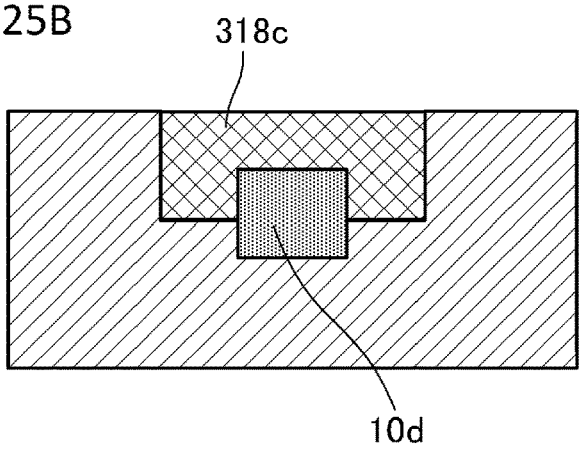

FIG. 25A is a schematic cross-sectional view showing a state in which an elastomer member (elastic member) 10*d* remains in a concave portion 300*d*. FIG. 25B is a schematic cross-sectional view when a liquid adhesive 318*c* is applied to the concave portion 300*d*.

The filling member of the concave portion is the adhesive member 318*a* obtained by stacking the double-sided adhesive tapes in the example in Embodiment 2 and, in Embodiment 3, the liquid adhesive 318*c* as a liquid adhesive member is used as the filling member.

Figure 25C:
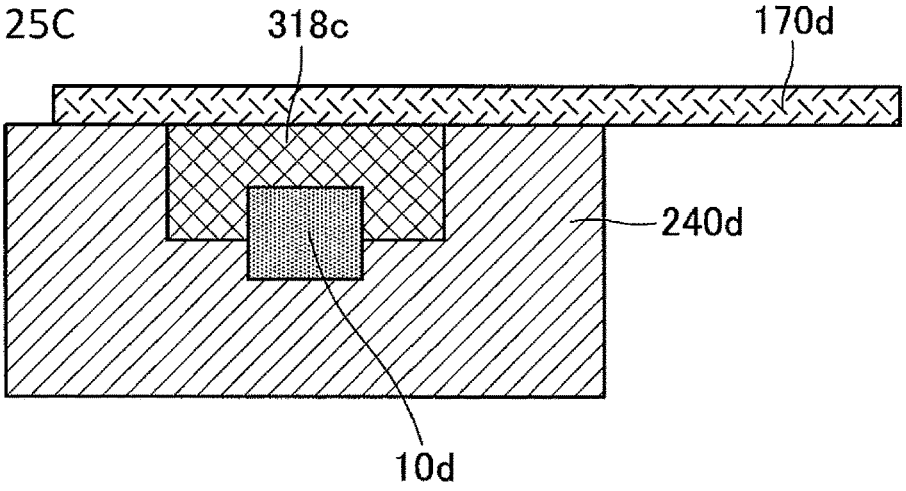
FIG. 25C is a schematic cross-sectional view when the sheet is attached.

That is, Embodiment 3 has the step of filling at least part of the concave portion 300*c* in which the elastomer member is formed with the adhesive member as the filling member, i.e., the liquid adhesive 318*c* in this embodiment (see FIGS. 25A and 25B), and the step of sticking another sheet 170*d* different from the sheet 15 with the liquid adhesive 318*c* (see FIG. 25C). The sheet 170*d* is a flexible member that prevents the toner leakage (developer leakage) to the outside.

As shown in FIG. 25A, Embodiment 3 is effective in the case where part of the elastomer member 10*d* remains in the concave portion 300*d* of a cleaning container 240*d*. That is, as shown in FIG. 25B, it is possible to easily fill the concave portion 300*d* by filling the concave portion 300*d* with the liquid adhesive 318*c*. It goes without saying that no problem is presented when the elastomer member 10*d* is removed. At this point, the liquid adhesive 318*c* may also be a melted resin such as a hot-melt adhesive.

The liquid adhesive 318*c* is substantially flush with regulating surfaces on both sides of the concave portion 300*d* in the lateral direction, and the sheet 170*d* is stuck with the liquid adhesive 318*c* (see FIG. 25C).

The basic configuration of the thus reproduced (newly manufactured) cartridge is a configuration in which the sheet 15 of the cartridge of FIG. 2 is replaced with the sheet 170*d*. To describe the configuration by using FIG. 2, the configuration includes the cleaning container 24 as the frame that includes the storage space serving as the toner storage portion, and the image carrier 21 as the rotator that is provided in the opening portion of the cleaning container 24 so as to be rotatable with respect to the cleaning container 24. In addition, the sheet 170*d* attached to the cleaning container 24 is configured to abut on the image carrier 21 to prevent the leakage of the toner from between the cleaning container 24 and the image carrier 21. The sheet position of the sheet 170*d* is positioned by the sheet position regulating surfaces 49, and the disposition of the sheet 170*d* relative to the cleaning container 24 is prevented from being displaced.

As described above, the concave portion 300*d* is formed in the surface to which the sheet 170*d* is attached, and the sheet 170*d* is fixed using at least part of the concave portion 300*d*, i.e., the liquid adhesive 318*c* as the filling member in this embodiment.

Embodiment 4

Next, Embodiment 4 will be described with reference to FIGS. 26A and 26B.

Figure 26A:
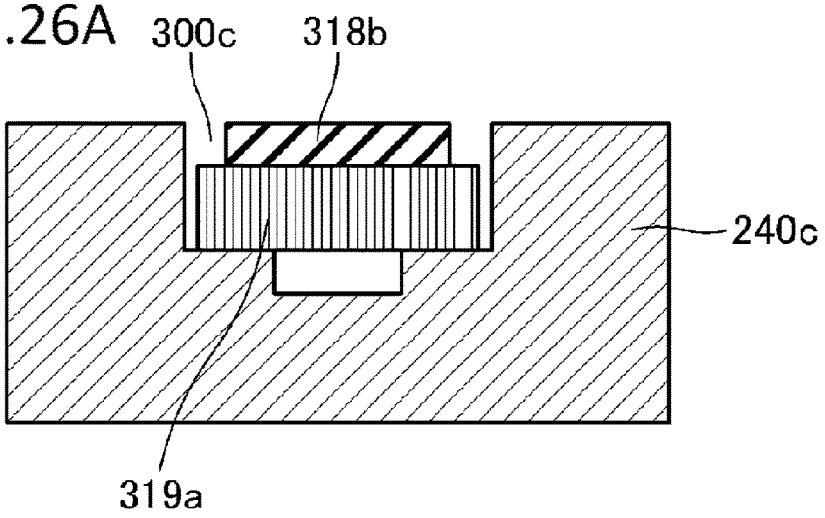
FIG. 26A is a schematic cross-sectional view of a state in which the adhesive member of Embodiment 4 is attached.
Figure 26B:
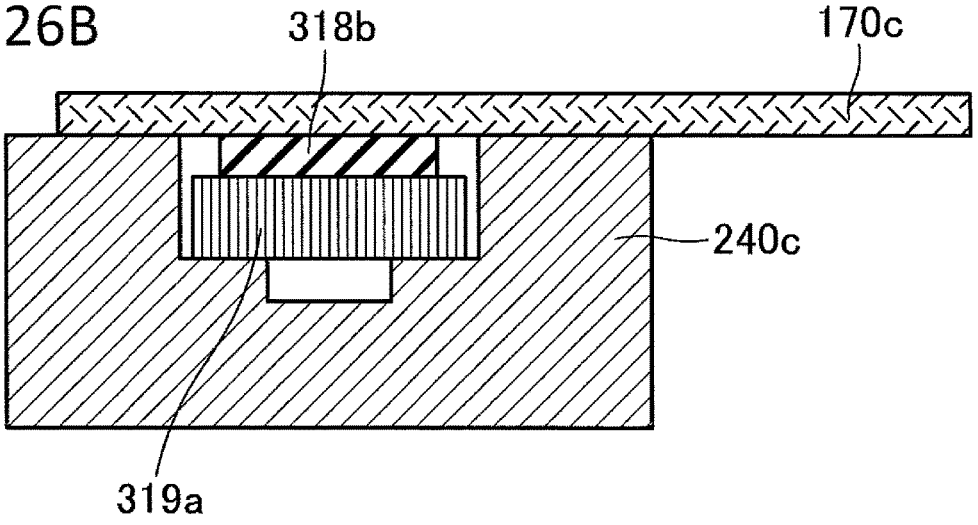
FIG. 26B is a schematic cross-sectional view of a state in which the sheet is attached.

FIG. 26A is a schematic cross-sectional view when a filling member 319*a* and a double-sided adhesive tape 318*b* are attached to a concave portion 300*c*, and FIG. 26B is a schematic cross-sectional view when a sheet 170*c* is attached to the double-sided adhesive tape 318*b*.

The filling member of the concave portion is the adhesive member in Embodiments 2 and 3, and Embodiment 4 is different from Embodiments 2 and 3 in that the filling member 319*a* is a member separate from the adhesive member, and is formed of plastic such as a thermoplastic resin.

That is, at least part of the concave portion 300*c* in which the elastomer member is formed is filled with the filling member 319*a*, and the step of attaching the double-sided adhesive tape 318*b* (see FIG. 26A) and the step of sticking the sheet 170*d* with the double-sided adhesive tape 318*b* (see FIG. 26B) are provided. The double-sided adhesive tape 318*b* may also be a liquid adhesive.

The basic configuration of the thus reproduced (newly manufactured) cartridge is a configuration in which the sheet 15 of the cartridge of FIG. 2 is replaced with the sheet 170*c*. To describe the configuration by using FIG. 2, the configuration includes the cleaning container 24 as the frame that includes the storage space serving as the toner storage portion, and the image carrier 21 as the rotator that is provided in the opening portion of the cleaning container 24 so as to be rotatable with respect to the cleaning container 24. In addition, the sheet 170*c* attached to the cleaning container 24 is configured to abut on the image carrier 21 to prevent the leakage of the toner from between the cleaning container 24 and the image carrier 21. The sheet position of the sheet 170*c* is positioned by the sheet position regulating surfaces 49, and the disposition of the sheet 170*c* relative to the cleaning container 24 is prevented from being displaced.

As described above, the concave portion 300*c* is formed in the surface to which the sheet 170*c* is attached, and the sheet 170*c* is fixed using at least part of the concave portion 300*c*, i.e., the filling member 319*a* and the double-sided adhesive tape 318*b* in this embodiment.

Embodiment 5

Next, Embodiment 5 will be described with reference to FIG. 27A and FIGS. 28A to 28D.

Figure 27A:
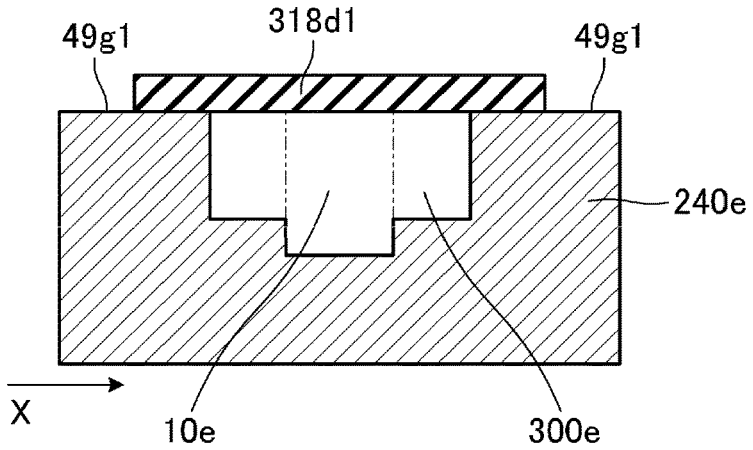
FIGS. 27A to 27C are schematic cross-sectional views of states in which the adhesive members of Embodiment 5 and Modifications are attached.
Figure 27B:
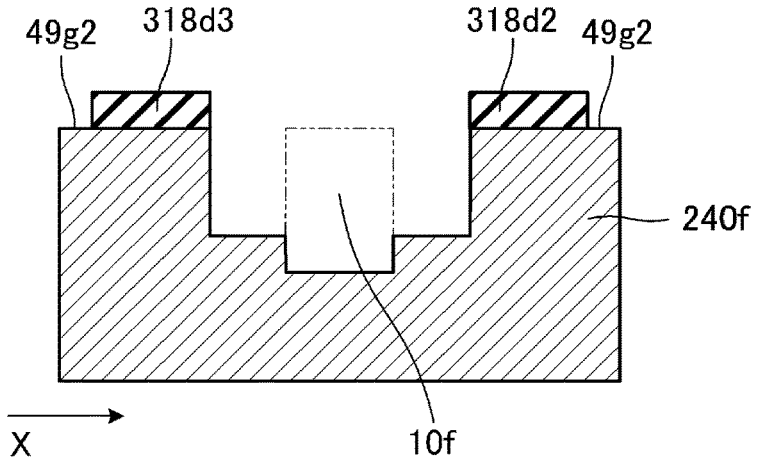

FIG. 27A is a schematic cross-sectional view in which a double-sided adhesive tape 318*d*1 is attached so as to cover a concave portion 300*e*, and FIGS. 28A to 28D are explanatory views of a state in which the sheet is attached.

In Embodiment 5, the double-sided adhesive tape 318*d*1 as the adhesive member is attached to sheet position regulating surfaces 49*g*1 as surfaces provided on both sides of the concave portion 300*e* in which an elastomer member (elastic member) 10*e* is provided in the lateral direction (see FIG. 27A). That is, the double-sided adhesive tape 318*d*1 is fixed to the sheet position regulating surfaces 49*g*1 so as to cover the concave portion 300*e*.

Figure 28A:
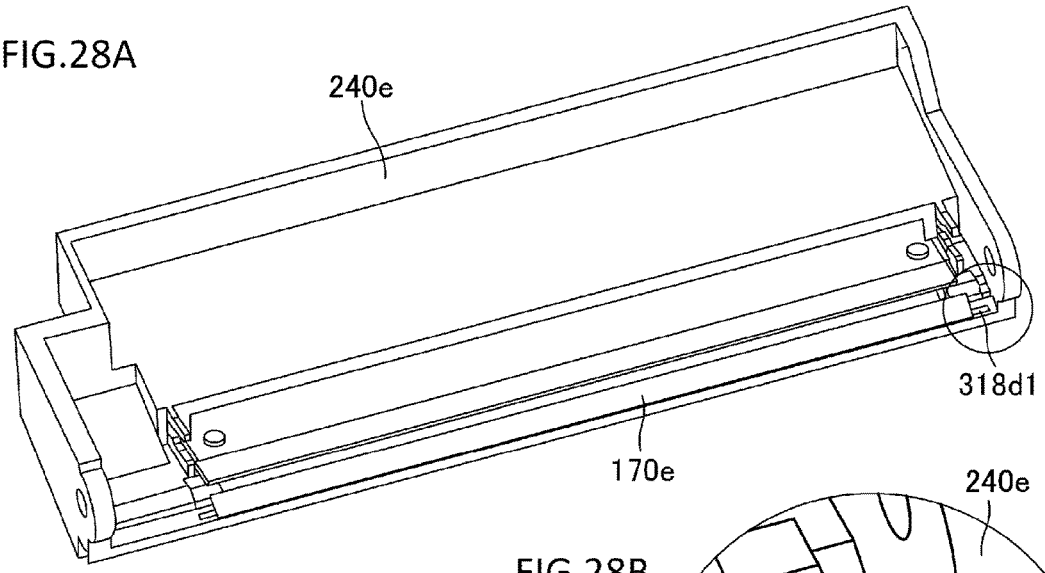
FIG. 28A is an explanatory view of a state in which the sheet is attached to the cleaning container of Embodiment 5.
Figure 28B:
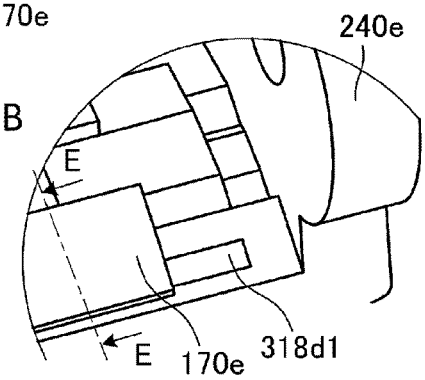
FIG. 28B is an enlarged view of a principal portion.
Figure 28C:
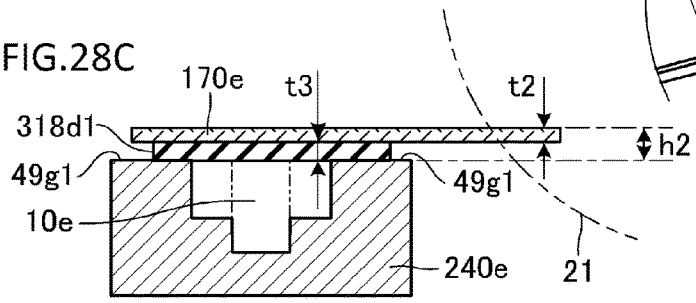
FIG. 28C is an enlarged cross-sectional view taken along the line E-E of FIG. 28B.

As shown in FIGS. 28A to 28C, re-fixation is performed by sticking a new sheet 170*e* (different from the sheet 15) with the double-sided adhesive tape 318*d*1. The sheet 170*e* is a flexible member that prevents the toner leakage (developer leakage) to the outside.

Figure 28D:
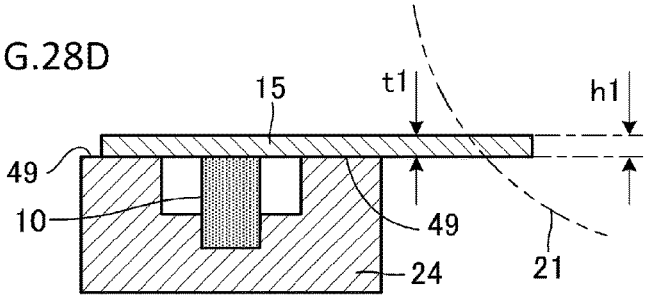
FIG. 28D is a cross-sectional view corresponding to FIG. 28C in a state before reproduction.

At this point, as shown in FIGS. 28C and 28D, there are cases where a contact height h2 of the sheet 170*e* with respect to the image carrier 21 is higher than a contact height h1 of the sheet 15 before reproduction with respect to the image carrier 21 by a distance corresponding to a thickness t3 of the double-sided adhesive tape 318*d*1. The heights from the sheet position regulating surfaces 49*g*1 and 49*g*1 to the sheet surfaces are indicated by the contact heights h1 and h2, respectively.

In this state, there are cases where an abutment pressure when the sheet 170*e* abuts on the image carrier 21 is increased, and the waste toner on the image carrier 21 is scraped.

To cope with this, by making a thickness t2 of the sheet 170*e* thinner than a thickness t1 of the sheet 15 before reproduction, the abutment pressure is made equal to that of the sheet 15 before reproduction (t2<t1).

In the present embodiment, the thickness t1 of the sheet 15 before reproduction=0.050 mm, the thickness t2 of the sheet 170*e*=0.038 mm, and the thickness t3 of the double-sided adhesive tape 318*d*1=0.130 mm were established. In the case where the elastic modulus of the sheet 170*e* is lower than the elastic modulus of the sheet 15 before reproduction, the abutment pressure at the time of abutment on the image carrier 21 is reduced by a value corresponding to the difference in the elastic modulus, and hence the thickness t2 of the sheet 170*e* may be made equal to or larger than the thickness t1 of the sheet 15. Specifically, in the case where the thickness t1 of the sheet 15 before reproduction=0.050 mm, the elastic modulus of the sheet 15 before reproduction=4 GPa, the thickness t3 of the double-sided adhesive tape 318*d*1=0.130 mm, and the elastic modulus of the sheet 170*e*=3 GPa are satisfied, the thickness t2 of the sheet 170*e*=0.070 mm is established. That is, by adjusting the thickness t2 of the sheet 170*e* and the elastic modulus, it is possible to make the abutment pressure equal to the abutment pressure of the sheet 15 before reproduction to the image carrier 21.

It goes without saying that, in the case where the influence of the abutment pressure can be ignored, the thickness t2 of the sheet 170*e* may be made equal to the thickness t1 of the sheet 15 (t2=t1).

The basic configuration of the thus reproduced (newly manufactured) cartridge is a configuration in which the sheet 15 of the cartridge of FIG. 2 is replaced with the sheet 170*e*. To describe the configuration by using FIG. 2, the configuration includes the cleaning container 24 as the frame that includes the storage space serving as the toner storage portion, and the image carrier 21 as the rotator that is provided in the opening portion of the cleaning container 24 so as to be rotatable with respect to the cleaning container 24. In addition, the sheet 170*e* attached to the cleaning container 24 is configured to abut on the image carrier 21 to prevent the leakage of the toner from between the cleaning container 24 and the image carrier 21.

As described above, the concave portion 300*e* is formed in the surface to which the sheet 170*e* is attached, and the sheet 170*e* is fixed to the sheet position regulating surfaces 49*g*1 provided on both sides of the concave portion 300*e* in the lateral direction using the double-sided adhesive tape 318*d*1.

Modifications of Embodiment 5

Next, Modifications of Embodiment 5 will be described with reference to FIGS. 27B and 27C and FIGS. 29A and 29B.

Modification 1 of Embodiment 5

In the example in FIG. 27A, the double-sided adhesive tape 318*d*1 is attached so as to cover the concave portion 300*e*. However, in an example shown in FIG. 27B, instead of the configuration in which the concave portion 300*e* is covered, double-sided adhesive tapes 318*d*2 and 318*d*3 are attached to sheet position regulating surfaces 49*g*2 on both sides as viewed in the lateral direction X of the concave portion 300*e*. At this point, the presence or absence of an elastomer member (elastic member) 10*f* does not matter. Further, the double-sided adhesive tape 318*d*2 or 318*d*3 may also be a liquid adhesive.

Figure 29A:
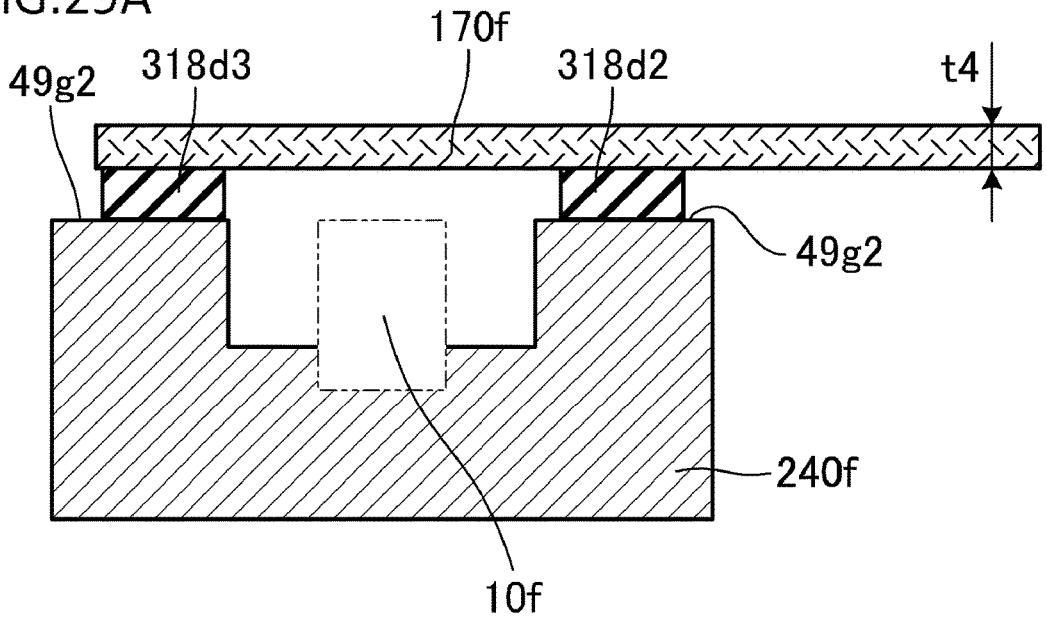
FIGS. 29A and 29B are schematic cross-sectional views of a state in which the sheets of Modifications of Embodiment 5 is attached.

As shown in FIG. 29A, another sheet 170*f* different from the sheet 15 is attached to the double-sided adhesive tapes 318*d*2 and 318*d*3. The sheet 170*f* is a flexible member that prevents the toner leakage (developer leakage) to the outside. At this point, a thickness t4 of the sheet 170*f* may be changed similarly to the case corresponding to Embodiment 5. In this manner, the concave portion 300*e* is covered with the double-sided adhesive tapes 318*d*2 and 318*d*3 and the sheet 170*f*.

Modification 2 of Embodiment 5

Figure 27C:
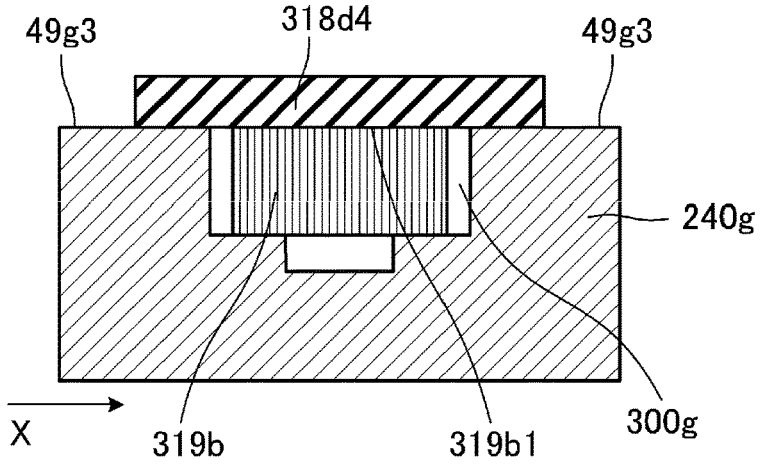

In the example in FIG. 27A, the double-sided adhesive tape 318*d*1 is attached so as to cover the hollow concave portion 300*e*. However, an example shown in FIG. 27C is a schematic cross-sectional view when a filling member 319*b* is attached to a concave portion 300*g* and a double-sided adhesive tape 318*d*4 is attached. That is, the concave portion

300*g* of a cleaning container 240*g* is filled with the filling member 319*b* formed of plastic or the like, and the double-sided adhesive tape 318*d*4 is attached. At this point, an upper surface 319*b*1 of the filling member 319*b* is substantially flush with sheet position regulating surfaces 49*g*3. In addition, the double-sided adhesive tape 318*d*4 may be attached to only the area of the upper surface 319*b*1 of the filling member 319*b* in the lateral direction X or may also be attached so as to overlap the sheet position regulating surface 49*g*3. Further, the double-sided adhesive tape 318*d*4 may also be a liquid adhesive.

Figure 29B:
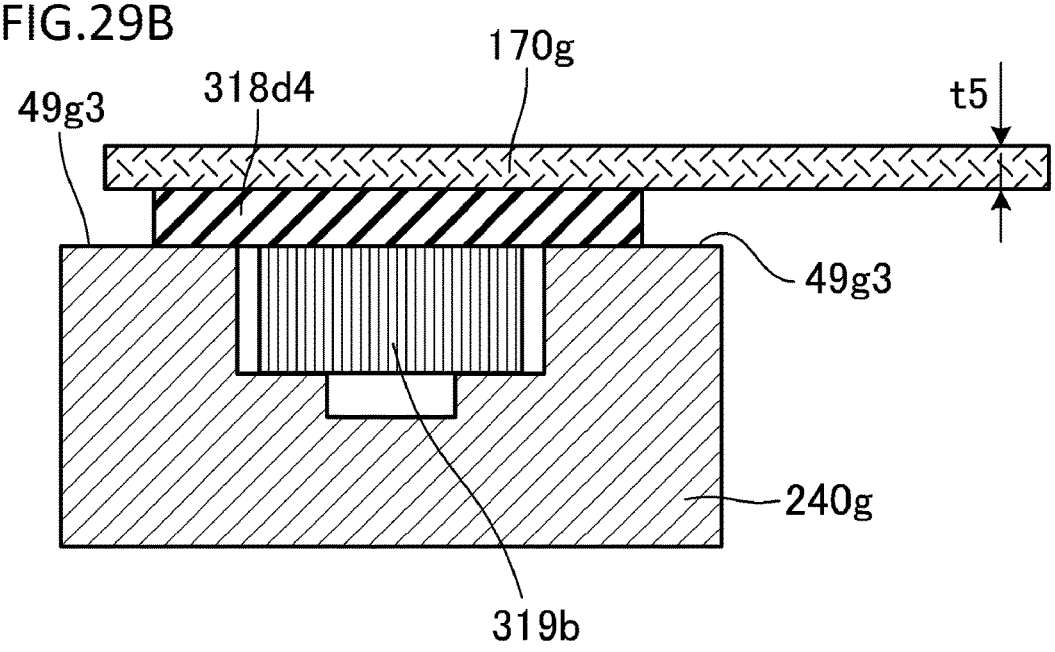

Subsequently, as shown in FIG. 29B, another sheet 170*g* different from the sheet 15 is attached to the double-sided adhesive tape 318*d*4. At this point, a thickness t5 of the sheet 170*g* may be changed similarly to the sheet 170*e* in Embodiment 5.

With the arrangement described above, the step of attaching the adhesive member is ended.

Another Embodiment

Next, another embodiment will be described by using FIGS. 30A to 30C.

In this embodiment, the sheet as the thin plate member is integrated with the adhesive member, and the attachment of the adhesive member and the sticking of the sheet are performed in one step.

Figure 30A:
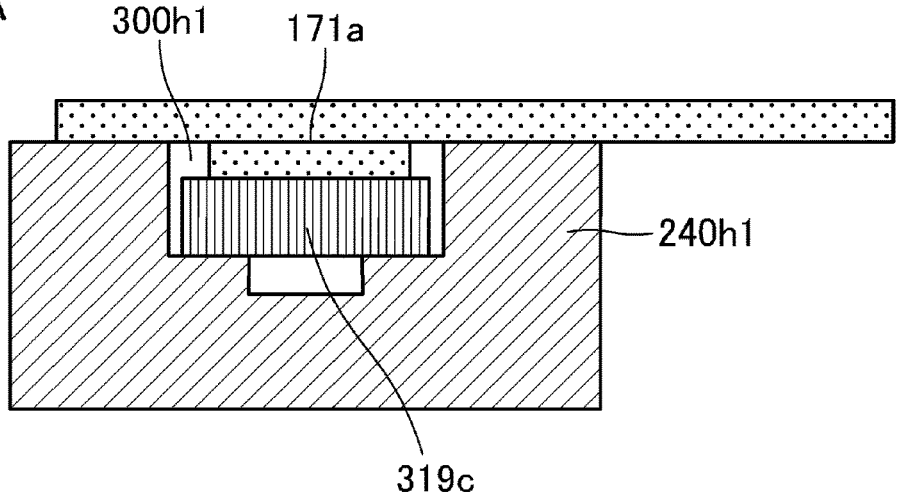
FIGS. 30A to 30C are schematic cross-sectional views of a state in which a composite sheet of another embodiment is attached.

FIG. 30A is a schematic cross-sectional view when a concave portion 300*h*1 is filled with a filling member 319*c*, and a sheet (hereinafter referred to as a composite sheet) 171*a* obtained by integrating the sheet with the adhesive member is attached. FIG. 30B is a schematic cross-sectional view when a concave portion 300*h*2 is filled with a filling member 319*d* and a composite sheet 171*b* is attached. FIG. 30C is a schematic cross-sectional view when a composite sheet 171*c* is attached to sheet position regulating surfaces 49*h*3.

In FIG. 30A, the concave portion 300*h*1 of a cleaning container 240*h*1 is filled with the filling member 319*c*, and the composite sheet 171*a* is attached.

Figure 30B:
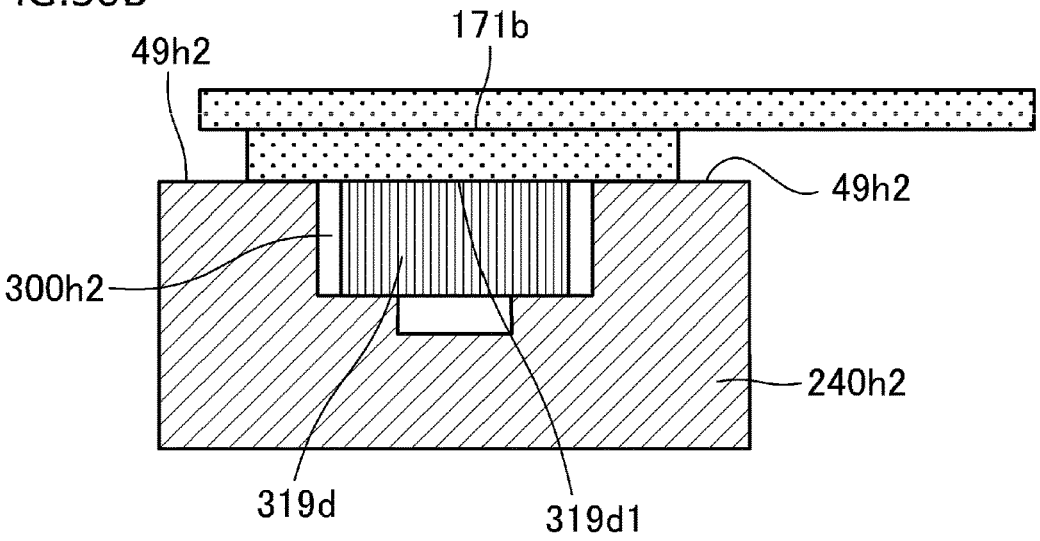

FIG. 30B shows an example in which the concave portion 300*h*2 of a cleaning container 240*h*2 is filled with the filling member 319*d*, and the composite sheet 171*b* is attached. At this point, an upper surface 319*d*1 of the filling member 319*d* is substantially flush with sheet position regulating surfaces 49*h*2. As described in Modification 2 of Embodiment 5, the area of the adhesive member of the composite sheet 171*b* may correspond to only the area of the upper surface 319*d*1 of the filling member 319*d*, or may also be attached so as to overlap the sheet position regulating surface 49*h*2.

Figure 30C:
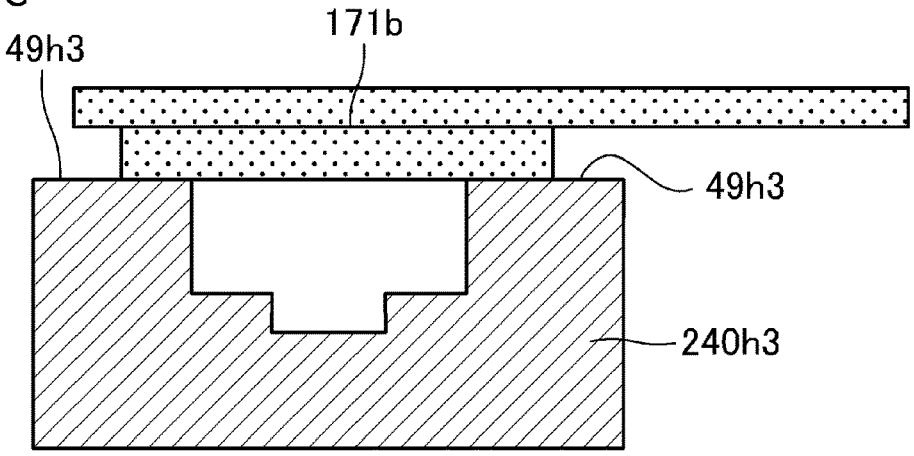

Further, as shown in FIG. 30C, the composite sheet 171*c* may also be attached to the sheet position regulating surfaces 49*h*3 of a cleaning container 240*h*3.

With the arrangement described above, the re-fixation of the sheet is ended.

Thereafter, the image carrier 21 is attached according to a procedure obtained by reversing the detachment procedure (not shown). At this point, a new image carrier may be used.

Thus, a series of steps of disassembling the cleaning unit 2*a* and attaching the sheet member have been described, and the present invention can also be applied to a method of replacing the sheet 16 of the developing unit 2*b* similarly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-016728, filed Jan. 29, 2016, which is hereby incorporated by reference herein in its entirety.

What is claimed is:

1. A method of manufacturing a cartridge that is attachable to an image forming apparatus by using a cartridge having a rotator, a frame that supports the rotator, an elastic member that is provided in a concave portion formed in the frame along a rotation axis direction of the rotator, and a sheet member that has one end portion fixed to the elastic member and another end portion abutting on the rotator along the rotation axis direction of the rotator, the manufacturing method comprising:

detaching the rotator from the frame;

detaching the sheet member from the frame;

detaching at least a part of the elastic member from the frame; and attaching another sheet member to the frame via an adhesive member that is attached to an adhesive member attachment portion formed between the concave portion and the another sheet member.

2. The manufacturing method according to claim 1, wherein the adhesive member attachment portion is provided in both sides of the concave portion in a direction orthogonal to a rotational axis of the rotator.

3. The manufacturing method according to claim 1, wherein the adhesive member attachment portion is formed in advance in the frame before reproduction.

4. The manufacturing method according to claim 1, wherein the adhesive member is a sticky material.

5. The manufacturing method according to claim 4, wherein the adhesive member is a double-sided adhesive tape that includes the sticky material.

6. The manufacturing method according to claim 1, wherein the adhesive member is a liquid adhesive member.

7. The manufacturing method according to claim 1, wherein the adhesive member is configured separately from the another sheet member, and the manufacturing method further comprises:

attaching the adhesive member to the adhesive member attachment portion; and sticking the another sheet member to the adhesive member.

8. The manufacturing method according to claim 1, wherein the attaching of the another sheet member is performed with the adhesive member after the another sheet member is integrated with the adhesive member.

9. The manufacturing method according to claim 1, wherein the elastic member is molded by injecting an elastic resin from an inlet of the frame into a molding space formed by causing a mold to abut on the frame.

10. The manufacturing method according to of claim 1, wherein when the sheet member is peeled from the frame, the elastic member is detached from the frame integrally with the sheet member in a state in which the elastic member is attached to a side of the sheet member.

11. The manufacturing method according to claim 1, wherein the rotator is an image carrier, the frame has a cleaning container that accommodates developer removed from the image carrier, and the sheet member and the another sheet member are flexible sheet members that abut on the image carrier to prevent leakage of the developer from between the cleaning container and the image carrier to outside of the cartridge.

12. The manufacturing method according to claim 1, wherein the rotator is a developer carrier that carries and transports developer, the frame has a developing container that accommodates the developer supplied to an image carrier, and the sheet member and the another sheet member are flexible sheet members that abut on the developer carrier to prevent leakage of the developer from between the developing container and the developer carrier to the outside of the cartridge.

13. A method of manufacturing a cartridge that is attachable to an image forming apparatus by using a cartridge having a rotator, a frame that supports the rotator, an elastic member that is provided in a concave portion formed in the frame along a rotation axis direction of the rotator, and a sheet member that has one end portion fixed to the elastic member and another end portion abutting on the rotator along the rotation axis direction of the rotator, the manufacturing method comprising:

detaching the rotator from the frame;

detaching the sheet member from the frame;

detaching the elastic member from the frame;

filling at least part of the concave portion with a filling member; and sticking another sheet member with an adhesive member via the filling member.

14. The manufacturing method according to claim 13, wherein the filling member is a thermoplastic resin.

15. The manufacturing method according to claim 13, wherein the filling member is constituted by the adhesive member.

16. A method of manufacturing a cartridge that is attachable to an image forming apparatus by using a cartridge having a rotator, a frame that supports the rotator, an elastic member that is provided in a concave portion formed in the frame along a rotation axis direction of the rotator, and a sheet member that has one end portion fixed to the elastic member and another end portion abutting on the rotator along the rotation axis direction of the rotator, the manufacturing method comprising:

detaching the rotator from the frame;

detaching the sheet member from the frame;

detaching the elastic member from the frame; and attaching another sheet member to surfaces provided on both sides of the concave portion in a direction orthogonal to a rotation axis of the rotator via an adhesive member.

17. The manufacturing method according to claim 16, wherein the adhesive member and the another sheet member are attached so as to cover at least part of the concave portion.

18. The manufacturing method according to claim 16, wherein a thickness of the another sheet member attached to the surfaces is different from the sheet member detached from the frame.

* * * * *